US008973510B2

(12) United States Patent
Kobayashi et al.

(10) Patent No.: US 8,973,510 B2
(45) Date of Patent: Mar. 10, 2015

(54) VESSEL

(75) Inventors: Noboru Kobayashi, Shizuoka (JP); Toshiaki Ibata, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 196 days.

(21) Appl. No.: 13/332,421

(22) Filed: Dec. 21, 2011

(65) Prior Publication Data

US 2012/0164896 A1 Jun. 28, 2012

Related U.S. Application Data

(60) Provisional application No. 61/425,828, filed on Dec. 22, 2010, provisional application No. 61/495,018, filed on Jun. 9, 2011.

(51) Int. Cl.

| | |
|---|---|
| ***B63B 35/73*** | (2006.01) |
| ***B63B 1/12*** | (2006.01) |
| ***B63B 29/04*** | (2006.01) |
| ***B63H 11/00*** | (2006.01) |

(52) U.S. Cl.

CPC ..... *B63B 1/121* (2013.01); *B63B 29/04* (2013.01); *B63H 11/00* (2013.01); *B63B 2029/043* (2013.01)

USPC ..... 114/55.5

(58) Field of Classification Search

CPC B63B 35/731; B63B 19/14; B63B 2001/186; B63B 2029/043; B63B 7/08; B63H 11/08

USPC ..... 114/55.5, 55.54, 55.55; 440/38; D12/307, 310

See application file for complete search history.

(56) References Cited

U.S. PATENT DOCUMENTS

| | | | | |
|---|---|---|---|---|
| 5,184,564 | A * | 2/1993 | Robbins et al. | 114/345 |
| 5,325,804 | A | 7/1994 | Schneider | |
| 5,372,083 | A * | 12/1994 | Hattori | 114/248 |
| 5,582,125 | A * | 12/1996 | Matsumoto | 114/55.5 |
| 6,112,685 | A * | 9/2000 | Matsuda et al. | 114/55.53 |
| 6,470,818 | B1 * | 10/2002 | Mears et al. | 114/68 |
| 6,672,240 | B1 * | 1/2004 | Aube et al. | 114/343 |
| D509,784 | S * | 9/2005 | Chase | D12/307 |
| 7,421,970 | B2 | 9/2008 | Levesque | |

* cited by examiner

*Primary Examiner* — S. Joseph Morano
*Assistant Examiner* — Andrew Polay
(74) *Attorney, Agent, or Firm* — Keating & Bennett, LLP

(57) ABSTRACT

A vessel includes a body including a hull and a deck, a float disposed on both right and left sides of the hull and extending in the front/rear direction along the hull, a propulsion unit that propels the vessel, a steering handle disposed above the deck, and a seat disposed at the rear of the steering handle on the deck. The deck includes a flat portion extending from the lateral side of the seat to the rear end edge of the deck.

11 Claims, 17 Drawing Sheets

VESSEL

This application claims the benefit of U.S. Provisional Application No. 61/425,828 filed on Dec. 22, 2010 and U.S. Provisional Application No. 61/495,018 filed on Jun. 9, 2011, and the contents of which are hereby incorporated by reference.

BACKGROUND OF THE INVENTION

1. Field of the Invention

The present invention relates to a vessel.

2. Description of the Related Art

In a conventional inflatable boat, both right and left sides of the hull are surrounded by a tubular float whose size is constant from the front to the rear, so that the float may become an obstacle when a passenger gets in or out of the boat. In U.S. Pat. No. 7,421,970, an inflatable boat in which a portion of the float is thinned to make it easy for a passenger to easily get in and out of the boat is described. In this boat, a wall to which an outboard motor is attached is provided at the rear end of the deck. However, no seat is described in U.S. Pat. No. 7,421,970, so that convenience in the case where a seat is provided is not sufficiently considered.

SUMMARY OF THE INVENTION

In order to overcome the previously unrecognized and unsolved challenges described above, a preferred embodiment of the present invention provides a vessel that includes a body, a float, at least one propulsion unit, a steering handle, and a seat. The body includes a hull and a deck disposed over the hull. The float is disposed on both right and left sides of the hull, and extends in the front/rear direction along the hull. The at least one propulsion unit includes a power source disposed between the hull and the deck, and a jet pump to be driven by the power source. The steering handle is disposed above the deck. The seat is disposed on the deck at the rear of the steering handle. The deck includes a flat portion extending from the lateral side of the seat to the rear end edge of the deck.

With this arrangement of the present preferred embodiment of the present invention, the flat portion extending from the lateral side of the seat to the rear end edge of the deck is provided on the deck. Therefore, a passenger can easily move between the seat and the rear side of the vessel by utilizing the flat portion. Therefore, a passenger easily gets in and out of the vessel, and workability on the vessel is excellent.

The float may include a pair of rear end portions spaced from each other in the right/left direction. In this case, the flat portion may include a rear end portion positioned between the pair of rear end portions as viewed from the rear.

The vessel may further include an openable and closable door that is disposed at the rear end portion of the flat portion and divides the space above the flat portion in the front/rear direction.

The float may include a front portion disposed forward relative to the seat, and a pair of narrow portions disposed on both right and left sides of the hull at a position corresponding to the seat with respect to the front/rear direction and disposed lower than the upper end of the front portion.

The float may be made of a rubber tube the inside of which is filled with gas, or may be made of foamed plastic.

The at least one propulsion unit may include a pair of propulsion units spaced from each other in the right/left direction. In this case, the flat portion may extend in the front/rear direction between the pair of propulsion units in a plan view.

The vessel may further include a movable division member that is disposed rearward relative to the seat and divides the space above the flat portion in the front/rear direction.

The vessel may further include a side seat disposed on the deck on the side opposite to the seat with respect to the flat portion.

The flat portion may surround the steering handle and the seat in a plan view.

The vessel may further include a rear seat disposed at the rear of the seat above the power source.

Another preferred embodiment of the present invention provides a vessel including a body, a float, at least one propulsion unit, a steering handle, and a seat. The body includes a hull and a deck disposed over the hull. The float is disposed on both right and left sides of the hull, and extends in the front/rear direction along the hull. The at least one propulsion unit includes a power source disposed between the hull and the deck, and a jet pump to be driven by the power source. The steering handle is disposed above the deck. The seat is disposed on the deck at the rear of the steering handle. The float includes a front portion disposed forward relative to the seat, and a pair of narrow portions disposed on both right and left sides of the hull at a position corresponding to the seat with respect to the front/rear direction and disposed lower than the upper end of the front portion.

With this arrangement of the present preferred embodiment of the present invention, the pair of narrow portions whose heights are relatively low are disposed at a position corresponding to the seat. Therefore, by passing through an area above the narrow portion in the right/left direction, a passenger can easily move between the seat and the lateral side of the vessel. Further, by utilizing the area above the narrow portion, a passenger can load or unload baggage without having to lift the baggage to a high position. Therefore, getting in/out of the vessel is easy, and workability on the vessel is excellent.

Still another preferred embodiment of the present invention provides a vessel including a body, a float, at least one propulsion unit, a steering handle, a seat, and a pair of narrow portions. The body includes a hull and a deck disposed over the hull. The float is disposed on both right and left sides of the hull, and extends in the front/rear direction along the hull. The at least one propulsion unit includes a power source disposed between the hull and the deck, and a jet pump to be driven by the power source. The steering handle is disposed above the deck. The seat is disposed on the deck at the rear of the steering handle. The pair of narrow portions are disposed at a position corresponding to the seat with respect to the front/rear direction so as to be spaced from each other in the right/left direction, and define side surfaces of the vessel at the position corresponding to the seat with respect to the front/rear direction. The pair of narrow portions are concave inward in a plan view. The pair of narrow portions may be provided on the float.

With this arrangement of the present preferred embodiment of the present invention, the pair of narrow portions that are concave inward in a plan view are disposed at a position corresponding to the seat. The pair of narrow portions define side surfaces of the vessel. Therefore, the vessel is narrowed at the position corresponding to the seat. Therefore, a passenger can easily move between the seat and the lateral side of the vessel by passing through the lateral side of the narrow portion. Further, by utilizing the lateral side of the narrow portion, a passenger can comparatively easily move a person or an object between a position in water and a position on the vessel. Therefore, getting in/out of the vessel is easy, and workability on the vessel is excellent.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
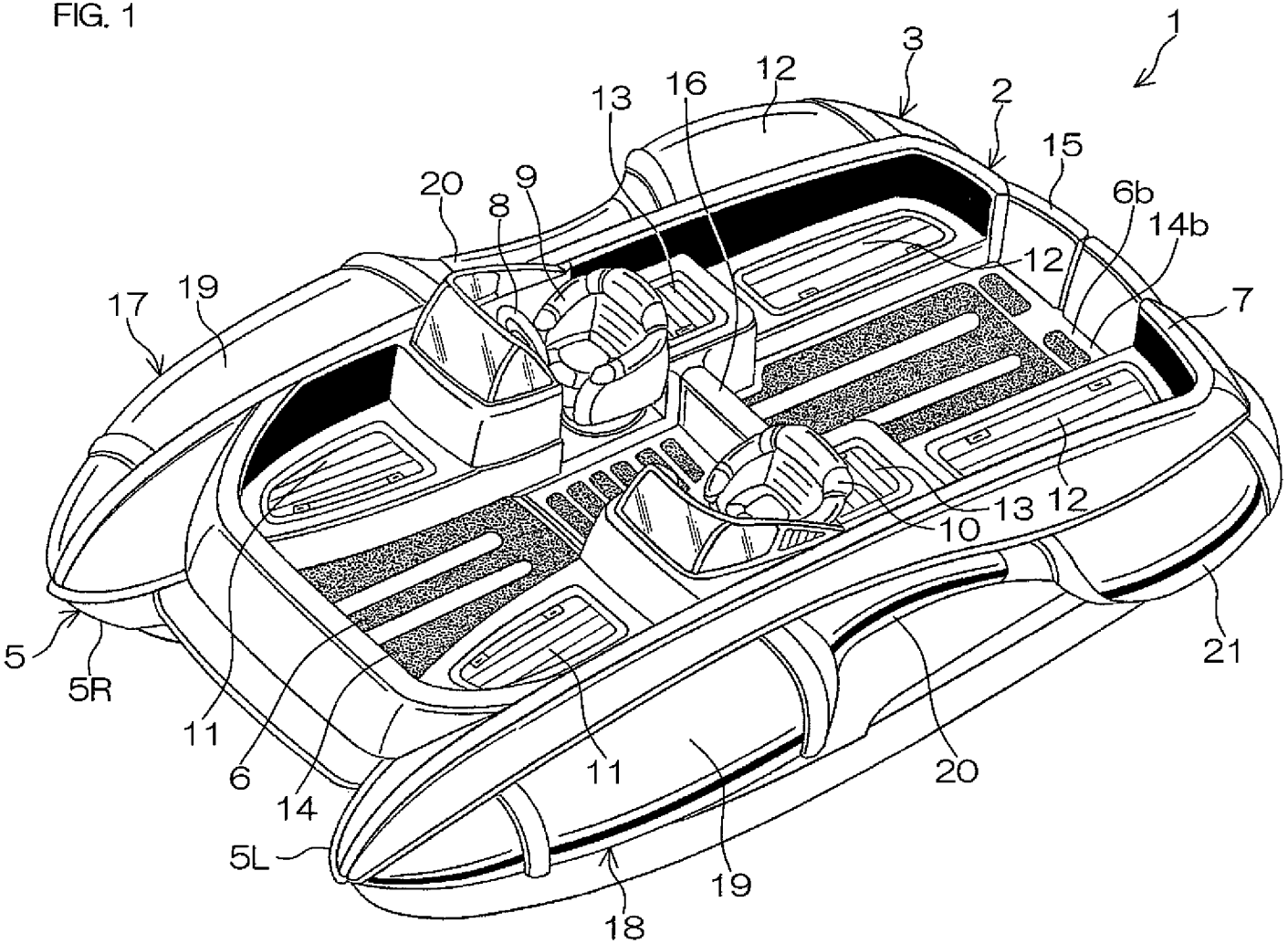
FIG. 1 is a perspective view of a vessel according to a first preferred embodiment of the present invention.

Hereinafter, a vessel in a stationary state in which the vessel is stationary on water is described. In each drawing, a vessel in the stationary state is shown. In the following description, "front/rear direction," "right/left direction," and "up/down direction" are directions based on a body in the stationary state. "Bilaterally symmetric" in the following description means symmetry about a vertical plane extending in the front/rear direction along the body center, that is, the center in the right/left direction of the body.

Multi-Work Jet

FIG. 1 to FIG. 11 are drawings for describing a Multi-Work Jet. FIG. 1 to FIG. 6 shows a "CAT-WORK RIB" Type Multi-Work Jet, and FIG. 7 to FIG. 11 shows a "MONO-WORK RIB" Type Multi-Work Jet. Hereinafter, features of the Multi-Work Jet are described. Thereafter, a detailed arrangement of the Multi-Work Jet is described.

The Multi-Work Jet preferably includes a wide hull with a jet propulsion engine. The wide hull ensures ample space to place loads inside the cockpit, which in turn enables the Jet Boat to be used as an active commercial vehicle. In this plan, the center of the hull is narrow with a door located at the rear to allow easy access when working on the water, as well as loading/unloading from the boat itself.

The wide hull not only contributes to the stability of the boat when stationary while working on water, but it also provides stability in motion when cruising with heavy loads. The width of the boat can be extended by either using the same material as the hull or by using a rib type structure.

However, surrounding the boat with a tube of identical size as seen in the standard rib structure may compromise its usability (when working on water) despite the increased stability.

In order to improve workability on the water, the shape is narrowed on the center of the hull in this plan similar to that of an ant's waist. Here we introduce two types of Multi-Work Jet: the Catamaran Type and the Mono hull Type.

The Cat-Work Rib on the Catamaran Type Multi-Work Jet includes a rib structure on the side outer panels of the hull, and two jet propulsion engines. There is a movable division on the center of the hull, but passengers are also able to move through the boat in a front-rear direction. The sides of the boat include large areas for storing ample amounts of luggage. There is also a door at the rear of the hull for easy access to water or a pier.

Except for the rear section on the "Mono-Work Rib" of the other Mono hull Type Multi-Work Jet, it is surrounded by a rib structure. The operator and the passenger seats are aligned in the front-rear direction along the center of the hull, which is surrounded by an easily accessible U-shaped floor. An Ant Waist design with narrow outer panels at the center of the hull is preferably included on this boat, as well as a door at the rear of the hull, for example. Both of these features enable easy access to water. This configuration enables the hull to be used more efficiently, and any load can be secured to the U-shaped floor when cruising.

First Preferred Embodiment

CAT-WORK RIB Type Multi-Work Jet

Figure 2:
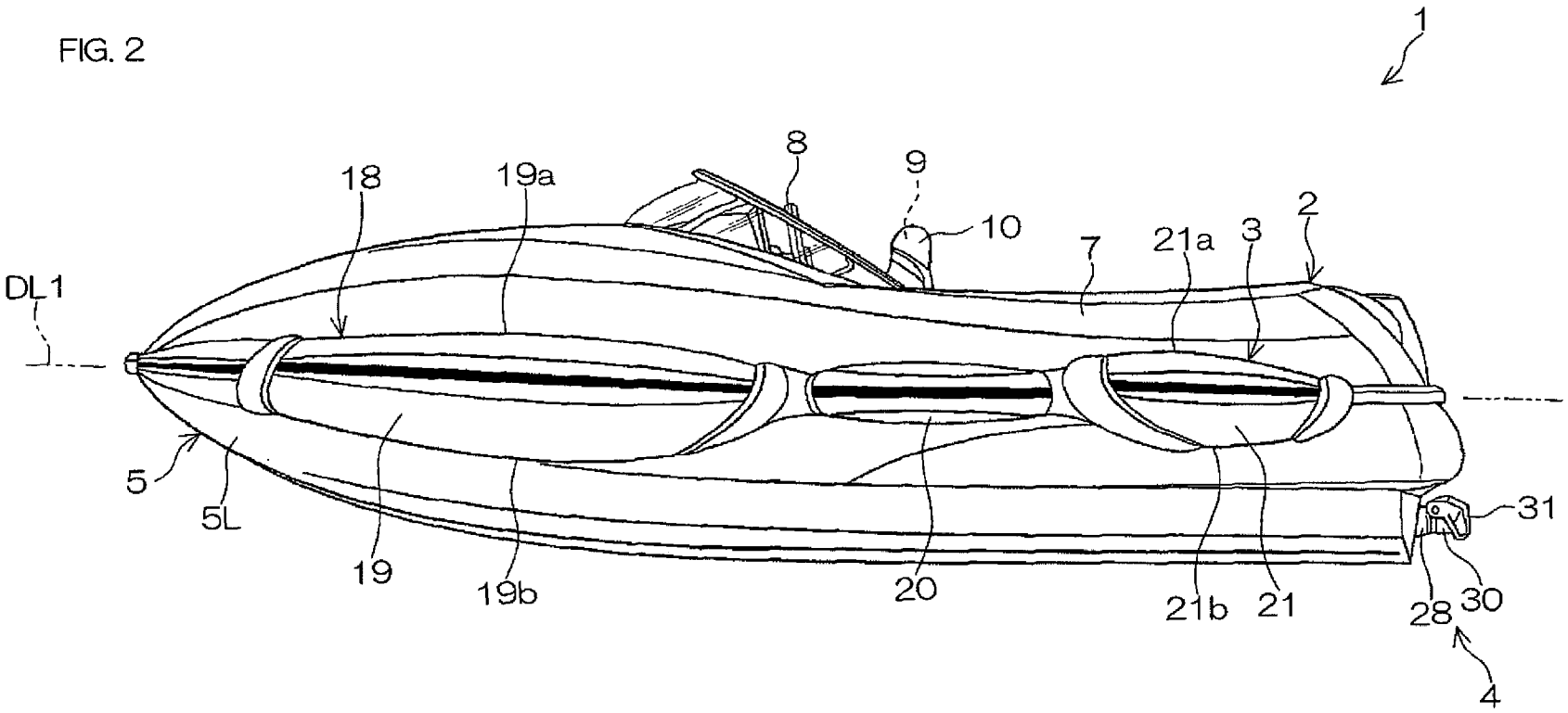
FIG. 2 is a side view of the vessel according to the first preferred embodiment of the present invention.
Figure 3:
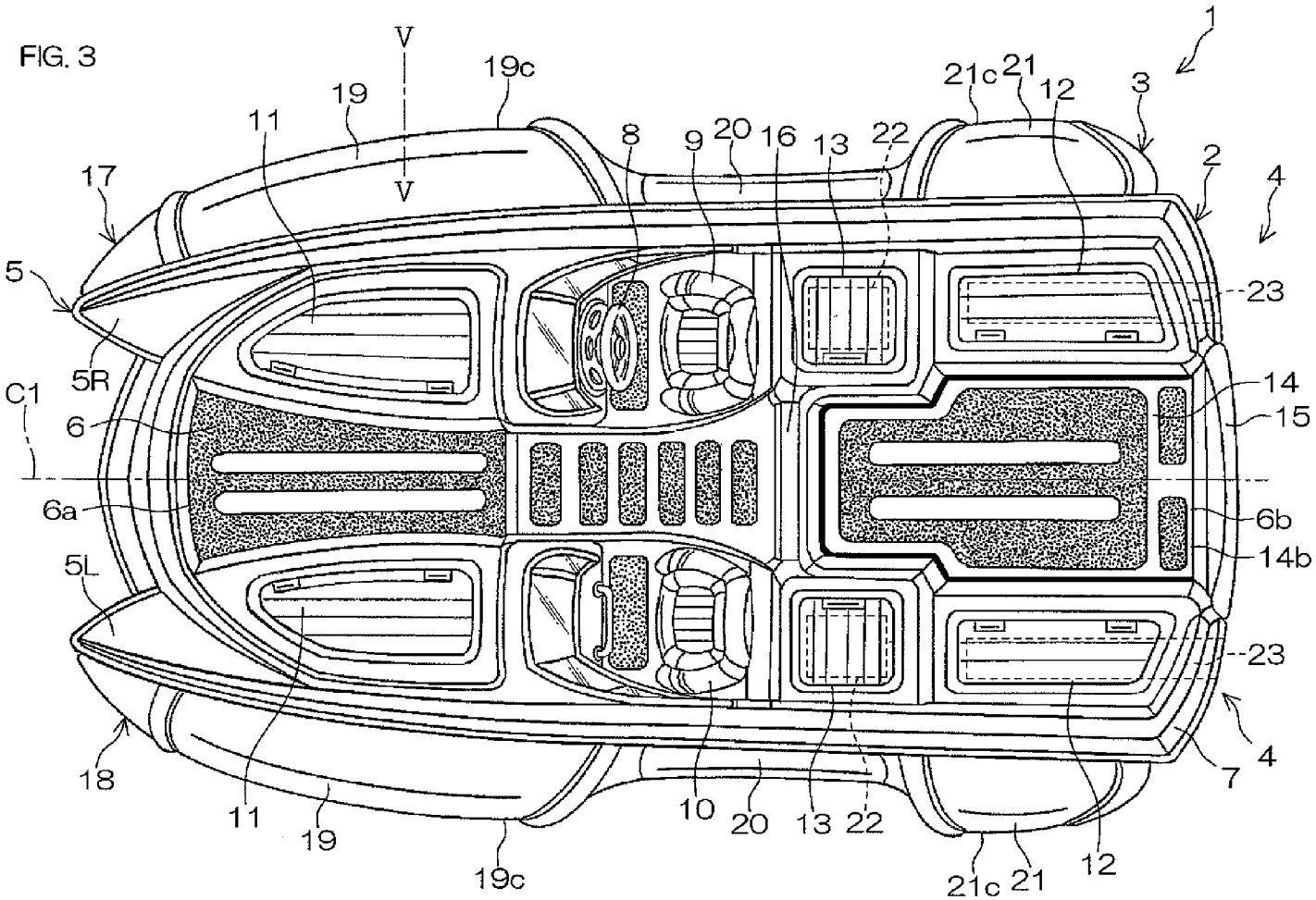
FIG. 3 is a plan view of the vessel according to the first preferred embodiment of the present invention.
Figure 4:
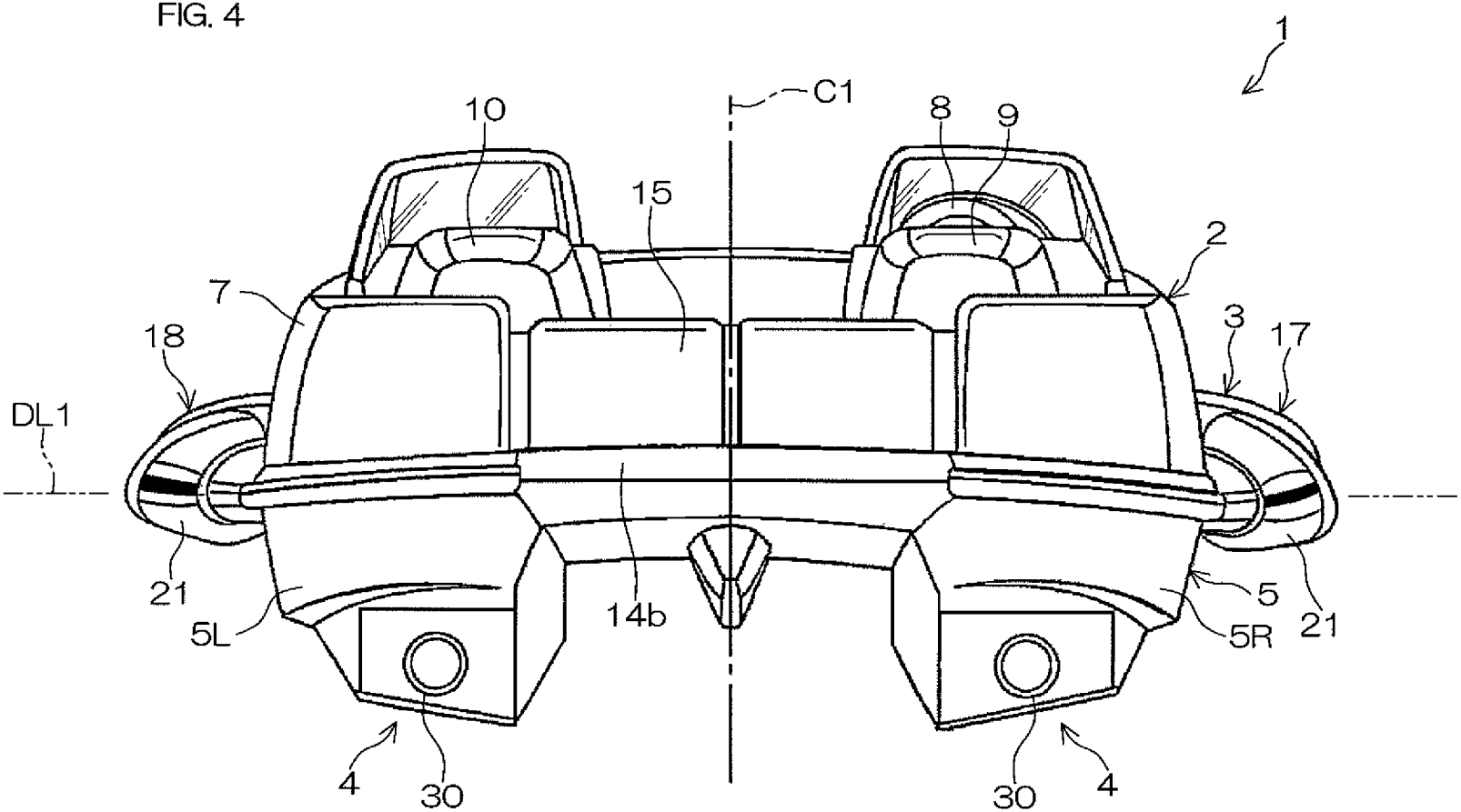
FIG. 4 is a back view of the vessel according to the first preferred embodiment of the present invention.
Figure 5A:
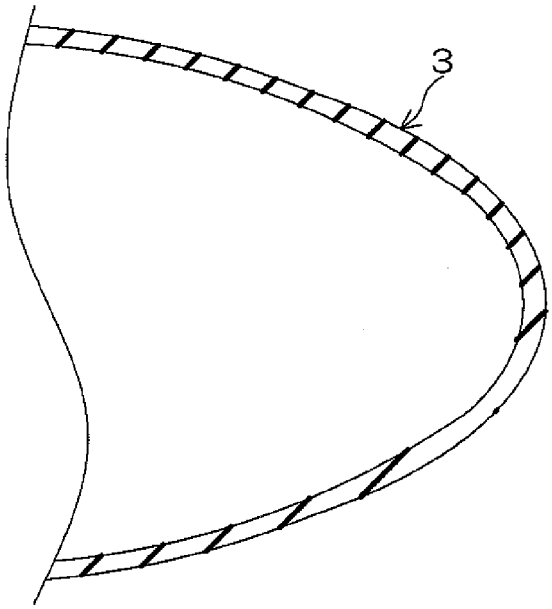
FIG. 5A is a sectional view of a float taken along line V-V in FIG. 3.
Figure 5B:
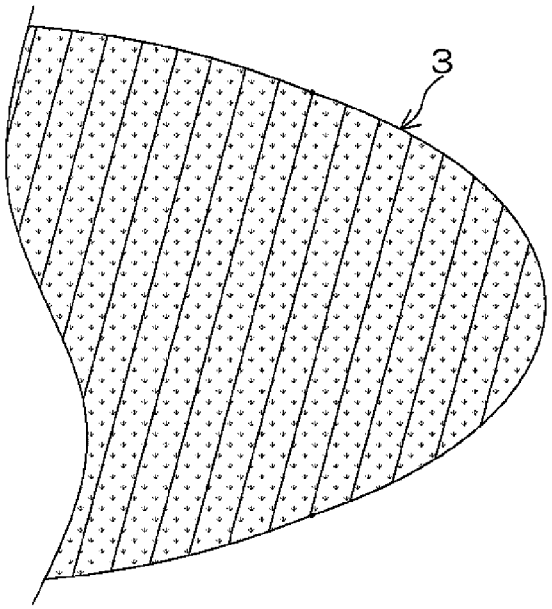
FIG. 5B is a sectional view of a float taken along line V-V in FIG. 3.
Figure 6:
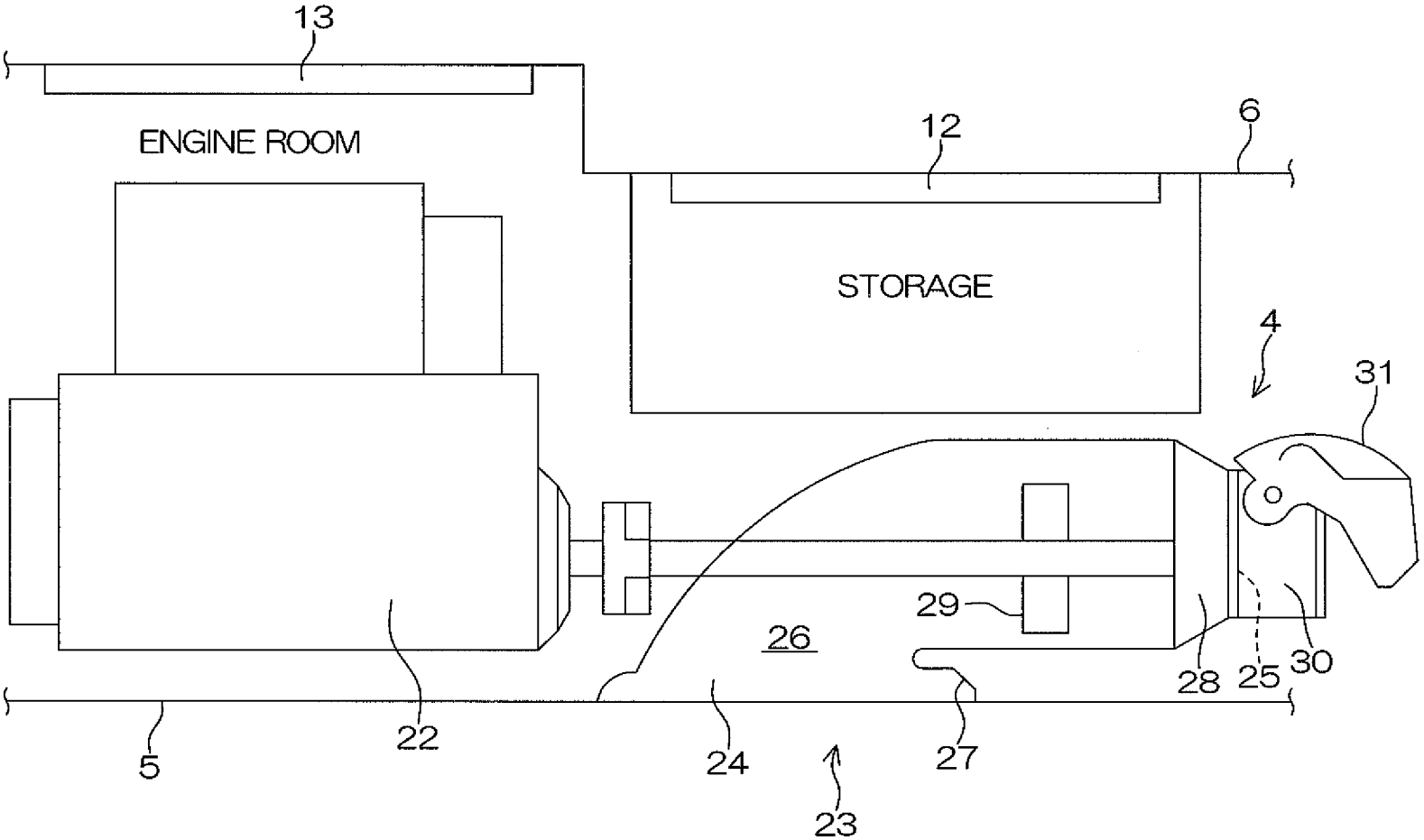
FIG. 6 is a schematic view of a propulsion unit from a lateral side.

FIG. 1 to FIG. 4 are a perspective view, a side view, a plan view, and a back view of a vessel 1, respectively. FIG. 5A and FIG. 5B are sectional views of a float 3 taken along line V-V in FIG. 3. FIG. 6 is a schematic view of a propulsion unit 4 from a lateral side. In FIG. 4, illustration of a reverse bucket 31 described later is omitted.

As shown in FIG. 4, the vessel 1 is a Catamaran type jet boat that is propelled by a jet propulsion engine. The Catamaran is a vessel including two hulls. As shown in FIG. 2, the vessel 1 includes a body 2, a float 3 that provides the body 2 with buoyancy, and a pair of propulsion units 4 that propels the vessel 1.

As shown in FIG. 1, the vessel 2 includes a hull 5 with a wide width that defines a vessel bottom, and a deck 6 disposed over the hull 5. The hull 5 has a bilaterally symmetric shape. As shown in FIG. 4, the hull 5 includes two hulls (a right hull 5R and a left hull 5L) coupled to each other. The pair of propulsion units 4 are held by the right hull 5R and the left hull 5L, respectively. The pair of propulsion units 4 are disposed at the same height so as to be spaced from each other in the right/left direction. The hull 5 is made of a material that is lightweight and has high strength such as FRP (fiber-reinforced plastics).

As shown in FIG. 1, the hull 5 includes an outer panel 7 having a C shape opened rearward in a plan view. The outer panel 7 surrounds the deck 6, and defines a passenger space in conjunction with the deck 6. A cockpit is provided in the passenger space. Specifically, as shown in FIG. 3, a seat 9 is disposed at the center portion in the front/rear direction of the deck 6, and the steering handle 8 is disposed in front of the seat 9. A side seat 10 is disposed on the lateral side of the seat 9. The seat 9 is an operator seat on which an operator sits, and the side seat 10 is a passenger seat on which a passenger other than an operator sits. An output adjustment lever to adjust outputs of the propulsion units 4 and to switch between forward drive and reverse drive (shift change) of the vessel 1 is also disposed in the cockpit although it is not illustrated. The steering handle 8 is disposed above the deck 6, and the seat 9 and the side seat 10 are disposed on the deck 6.

As shown in FIG. 3, the seat 9 and the side seat 10 are disposed along the right end and the left end of the hull 5, respectively. A front storage door 11 and a rear storage doors 12 to open and close storages provided underneath the deck 6 are disposed at the front and rear of the seat 9. Similarly, the front storage door 11 and the rear storage door 12 are disposed at the front and rear of the side seat 10, respectively. Engine doors 13 to open and close engine rooms provided underneath the deck 6 are disposed between the rear storage doors 12 and the seats (the seat 9 or the side seat 10). As shown in FIG. 1, the doors 11, 12, and 13 are held in horizontal postures, and openable and closable up and down. The engine doors 13 are disposed higher than the front storage doors 11 and the rear storage doors 12, and define level differences in conjunction with the rear storage doors 12.

As shown in FIG. 3, the seat 9 and the side seat 10 are disposed bilaterally symmetrically so as to be spaced from each other in the right/left direction. Between the seat 9 and the side seat 10, a flat portion 14 extending in the front/rear direction along the body center C1 is provided. The flat portion 14 is a portion of the deck 6, and extends from the front end edge 6*a* of the deck 6 to the rear end edge 6*b* of the deck 6. The upper surface of the flat portion 14 may be a plane without irregularities, or may be a substantially flat surface provided with concave portions or convex portions so small (for example, several centimeters) that no trouble occurs when a passenger moves on the flat portion 14. The flat portion 14 extends in the front/rear direction between the pair of propulsion units 4 in a plan view.

As shown in FIG. 1, a rear end portion 14*b* of the flat portion 14 is disposed at an opening portion of the outer panel 7. A rear door 15 is disposed at the rear end portion 14*b* of the flat portion 14. The opening portion of the outer panel 7 is closed by the rear door 15. A movable division member 16 is disposed at the center portion in the front/rear direction of the flat portion 14. The division member 16 projects upward from the flat portion 14, and is disposed rearward relative to the seat 9 and the side seat 10. The rear door 15 and the division member 16 divide the space above the flat portion 14 into the front and rear. Water moving from the rear side to the front side of the rear door 15 is backed up by the rear door 15, and water moving from the rear side to the front side of the division member 16 is backed up by the division member 16. Therefore, the area from the division member 16 to the front end edge 6*a* of the deck 6 is a dry area protected from water entering from the rear side.

The rear door 15 may be a swing door that swings around an axis extending up and down or right and left, a sliding door movable parallel up and down or right and left, or an accordion door foldable up and down or right and left. The rear door 15 may be a single door or a double door. When the rear door 15 is a sliding door, the rear door 15 may be removable from the hull 5. Like the rear door 15, the division member 16 may be a swing door, a sliding door, or an accordion door.

As shown in FIG. 3, the float 3 includes a right float 17 and a left float 18 disposed on the right side and the left side of the hull 5. The right float 17 and the left float 18 extend in the front/rear direction along the side surfaces (outer surfaces) of the hull 5. The float 3 has a bilaterally symmetric shape. Specifically, the right float 17 and the left float 18 are disposed bilaterally symmetrically so as to be spaced from each other in the right/left direction, and the right float 17 has a shape right/left-reverse to the left float 18. The right float 17 and the left float 18 are disposed on the outermost side of the vessel 1, and define side surfaces of the vessel 1. As shown in FIG. 2, the attachment position of the float 3 to the hull 5 is set so that the height of the draft line DL1 in a stationary state of the vessel 1 becomes equal to the position of the float 3. The float 3 may be a rubber-made tube the inside of which is filled with gas as shown in FIG. 5A, or may be made of foamed plastic as shown in FIG. 5B. When the float 3 is a tube, the insides of the right float 17 and the left float 18 may be divided into pluralities of sections in the longitudinal direction.

As shown in FIG. 2, the right float 17 and the left float 18 extend in the front/rear direction along the center portion in the up/down direction of the hull 15. The right float 17 and the left float 18 extend rearward from the front end of the hull 5. The rear end portions of the right float 17 and the left float 18 are disposed forward relative to the rear end of the hull 5. As shown in FIG. 4, when the vessel 1 is viewed from the back, the rear end portion 14*b* of the flat portion 14 is positioned between the rear end portion of the right float 17 and the rear end portion of the left float 18. As shown in FIG. 2, each of the right float 17 and the left float 18 includes a front portion 19 disposed forward relative to the seat 9, a rear portion 21 disposed rearward relative to the seat 9, and a narrow portion 20 disposed between the front portion 19 and the rear portion 21. The narrow portion 20 is disposed at a position corresponding to the seat 9 with respect to the front/rear direction (the right side or the left side of the seat 9).

As shown in FIG. 3, the narrow portion 20 is disposed on the inner side (the body center C1 side) relative to the outer end 19*c* of the front portion 19 and the outer end 21*c* of the rear portion 21. Therefore, the right float 17 and the left float 18 are concave inward at the position corresponding to the seat 9. Therefore, the center portion in the front/rear direction of the vessel 1 is narrower in width than the portions forward and rearward of the center portion, and is narrowed in the right/left direction like a petiole of an ant. Further, as shown in FIG. 2, the narrow portion 20 is narrower in the up/down direction than the front portion 19 and the rear portion 21. The narrow portion 20 is disposed lower than the upper end 19*a* of the front portion 19 and the upper end 21*a* of the rear portion 21, and disposed higher than the lower end 19*b* of the front portion 19 and the lower end 21*b* of the rear portion 21. Therefore, the right float 17 and the left float 18 are concave up and down at the position corresponding to the seat 9.

As shown in FIG. 6, each propulsion unit 4 includes a power source 22 disposed between the hull 5 and the deck 6, and a jet pump 23 to be driven by the power source 22. The power source 22 is disposed in front of the jet pump 23. The jet pump 23 is disposed at the stern. The power source 22 may be either an internal combustion engine or an electric motor, or both of an internal combustion engine and an electric motor. Of course, a device other than an internal combustion engine and an electric motor may be used as the power source 22. The jet pump 23 is powered from the power source 22 and suctions water from the vessel bottom and jets the suctioned water rearward or forward. Accordingly, the vessel 1 is propelled. Further, the jet pump 23 changes the jet flow direction to the right/left according to an operation of the steering handle 8. Accordingly, the vessel 1 is steered.

As shown in FIG. 6, the power source 22 is disposed (in an engine room) below the engine door 13, and a portion of the jet pump 23 is disposed below the rear storage door 12. A storage compartment preferably is provided between the jet pump 23 and the rear storage door 12. The jet pump 23 defines an inlet 24 opened downward on the vessel bottom, an outlet 25 opened rearward at the rear side relative to the inlet 24, and a flow channel 26 that connects the inlet 24 and the outlet 25. The jet pump 23 includes a duct 27 that defines the inlet 24, a nozzle 28 that defines the outlet 25, an impeller 29 disposed in the flow channel 26, a deflector 30 that changes the direction of a jet flow jetted from the nozzle 28 to the right/left, and a reverse bucket 31 that changes the jet direction of water from the deflector 30 to forward/rearward. The deflector 30 turns clockwise and counterclockwise according to an operation of the steering handle 8, and the reverse bucket 31 turns up and down according to an operation of an output adjustment lever (not illustrated) disposed in the cockpit.

As described above, in the first preferred embodiment, the flat portion 14 extending from the lateral side of the seat 9 to the rear end edge 6*b* of the deck 6 is provided on the deck 6. Therefore, a passenger can easily move between the seat 9 and the rear side of the vessel 1 by utilizing the flat portion 14. Therefore, getting in/out of the vessel is easy, and workability on the vessel is excellent.

Further, a pair of narrow portions 20 which are relatively low in height are disposed at the position corresponding to the seat 9, so that a passenger can easily move between the seat 9 and the lateral side of the vessel 1 by moving the area above the narrow portion 20 in the right/left direction. Further, by utilizing the area above the narrow portion 20, a passenger can perform loading and unloading baggage without lifting the baggage to a high position. Therefore, getting in/out of the vessel is easy, and workability on the vessel is excellent.

Further, the pair of narrow portions 20 are concave inward in a plan view. In addition, the pair of narrow portions 20 define side surfaces of the vessel 1. Therefore, the vessel 1 is narrowed in the right/left direction at the position corresponding to the seat 9. Therefore, by passing through the lateral side of the narrow portion 20, a passenger can easily move between the seat 9 and the lateral side of the vessel 1. Further, by utilizing the lateral side of the narrow portion 20, a passenger can comparatively easily move a person or object between a position in water and a position on the vessel. Therefore, getting in/out of the vessel is easy, and workability on the vessel is excellent.

Second Preferred Embodiment

MONO-WORK RIB Type Multi-Work Jet

FIG. 7 to FIG. 10 are a perspective view, a side view, a plan view, and a back view of a vessel 201. FIG. 11 is a schematic view of a propulsion unit 4 from the lateral side. In FIG. 7 to FIG. 11, components equivalent to the components shown in FIG. 1 to FIG. 6 described above are designated by the same reference numerals as in FIG. 1, etc., and description thereof is omitted.

Figure 8:
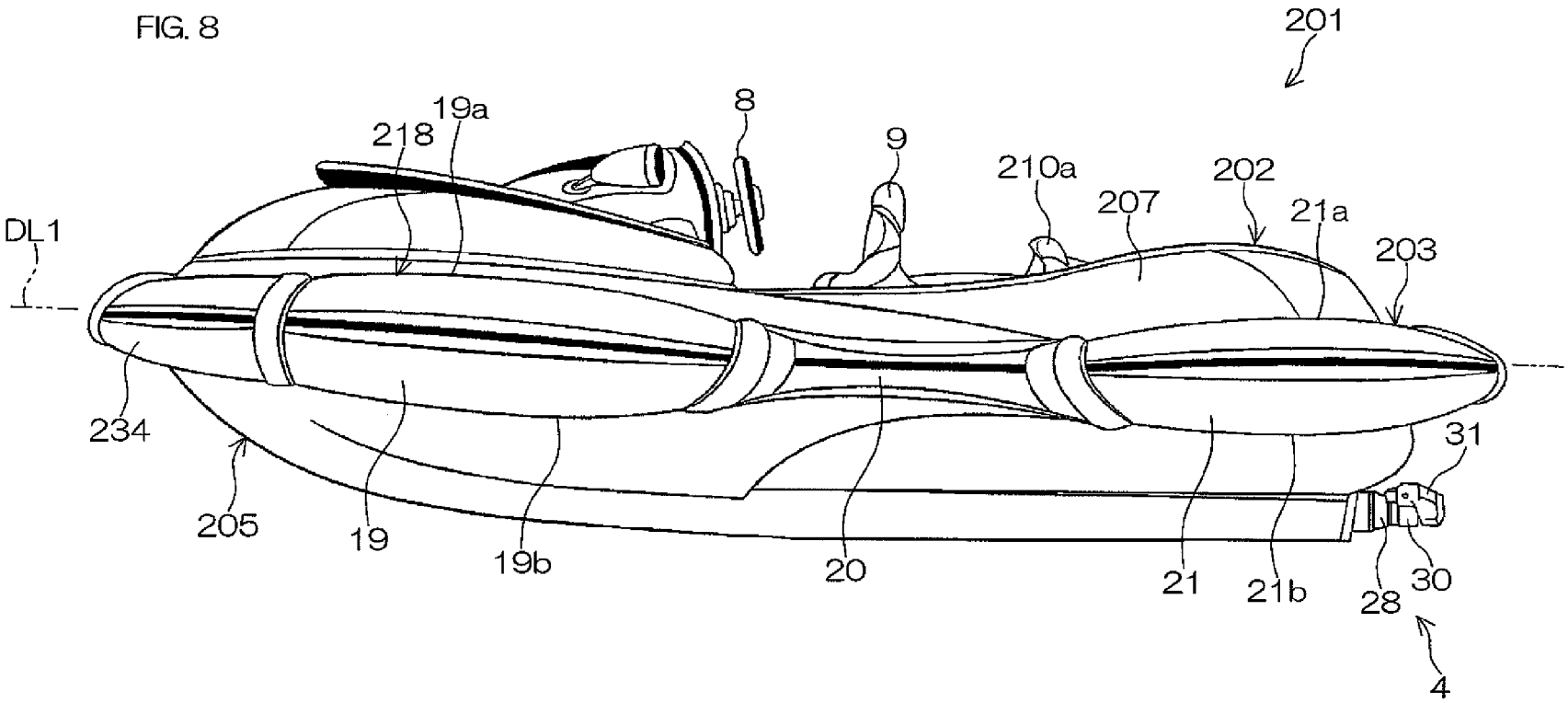
FIG. 8 is a side view of the vessel according to the second preferred embodiment of the present invention.
Figure 10:
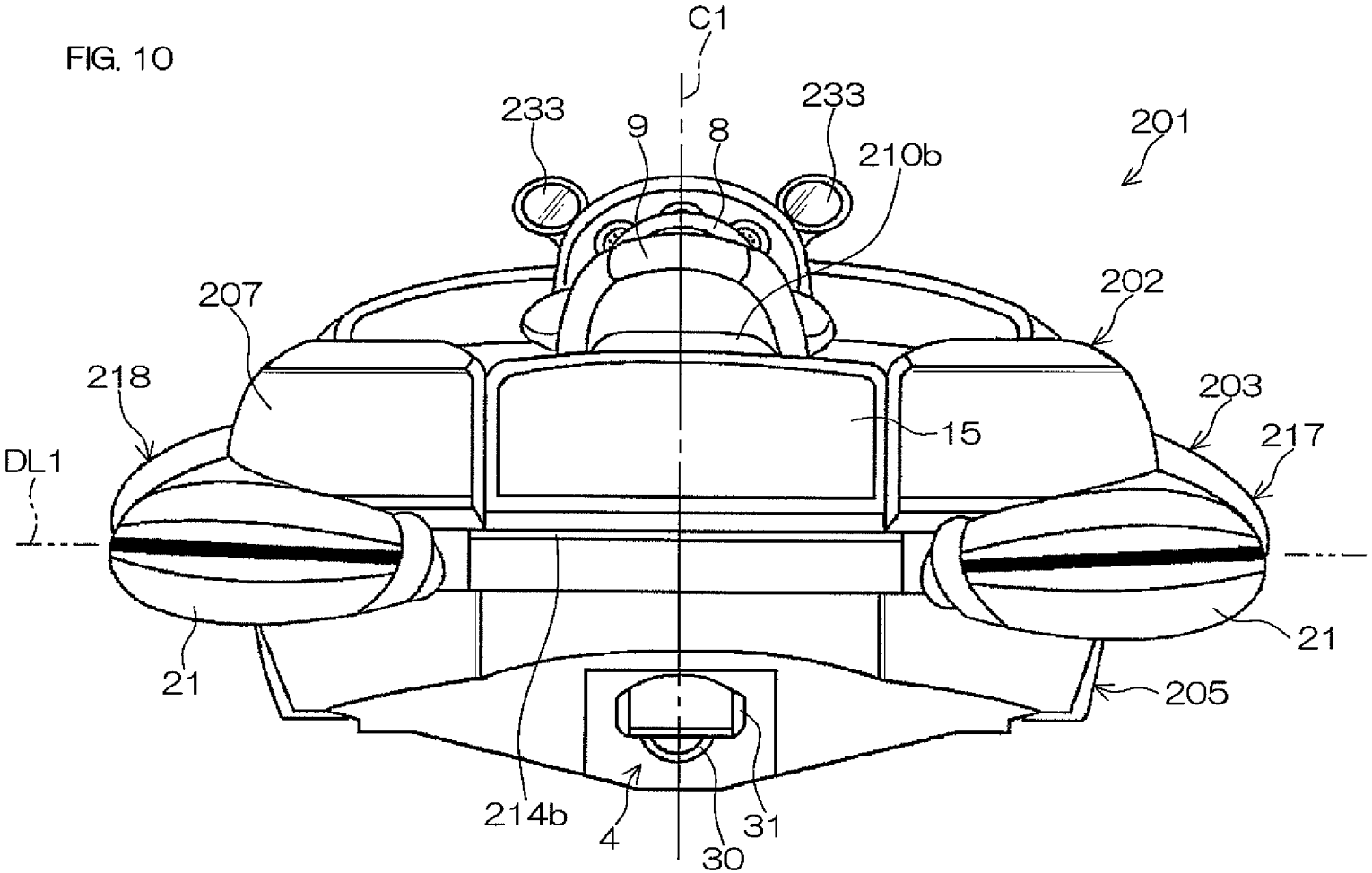
FIG. 10 is a back view of the vessel according to the second preferred embodiment of the present invention.
Figure 11:
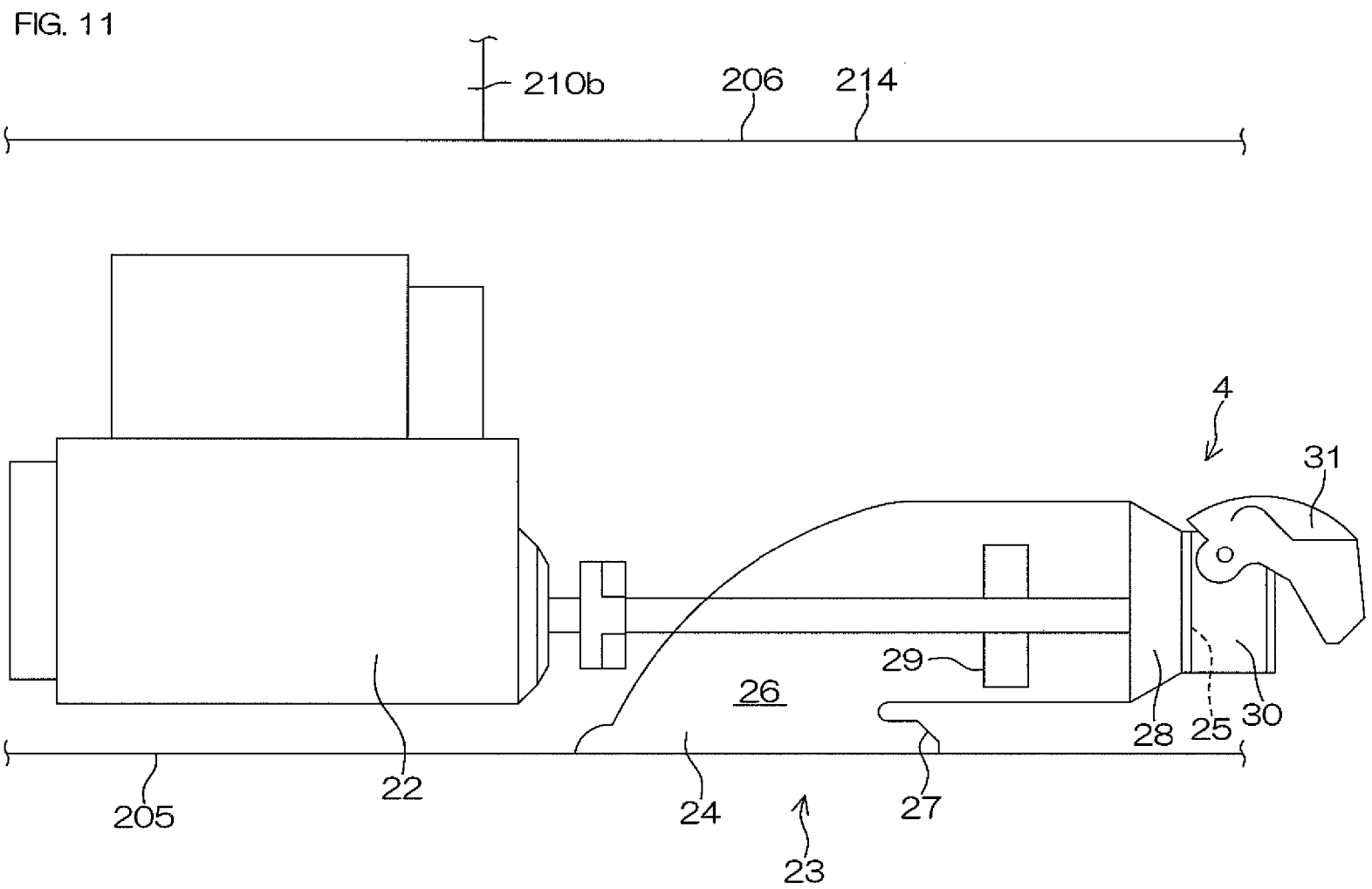
FIG. 11 is a schematic view of a propulsion unit from the lateral side.

As shown in FIG. 10, the vessel 201 is a Mono hull type jet boat that is propelled by a jet propulsion engine. As shown in FIG. 8, the vessel 201 includes a body 202, a float 203 that gives the body 202 buoyancy, and the propulsion unit 4 that propels the vessel 201.

Figure 9:
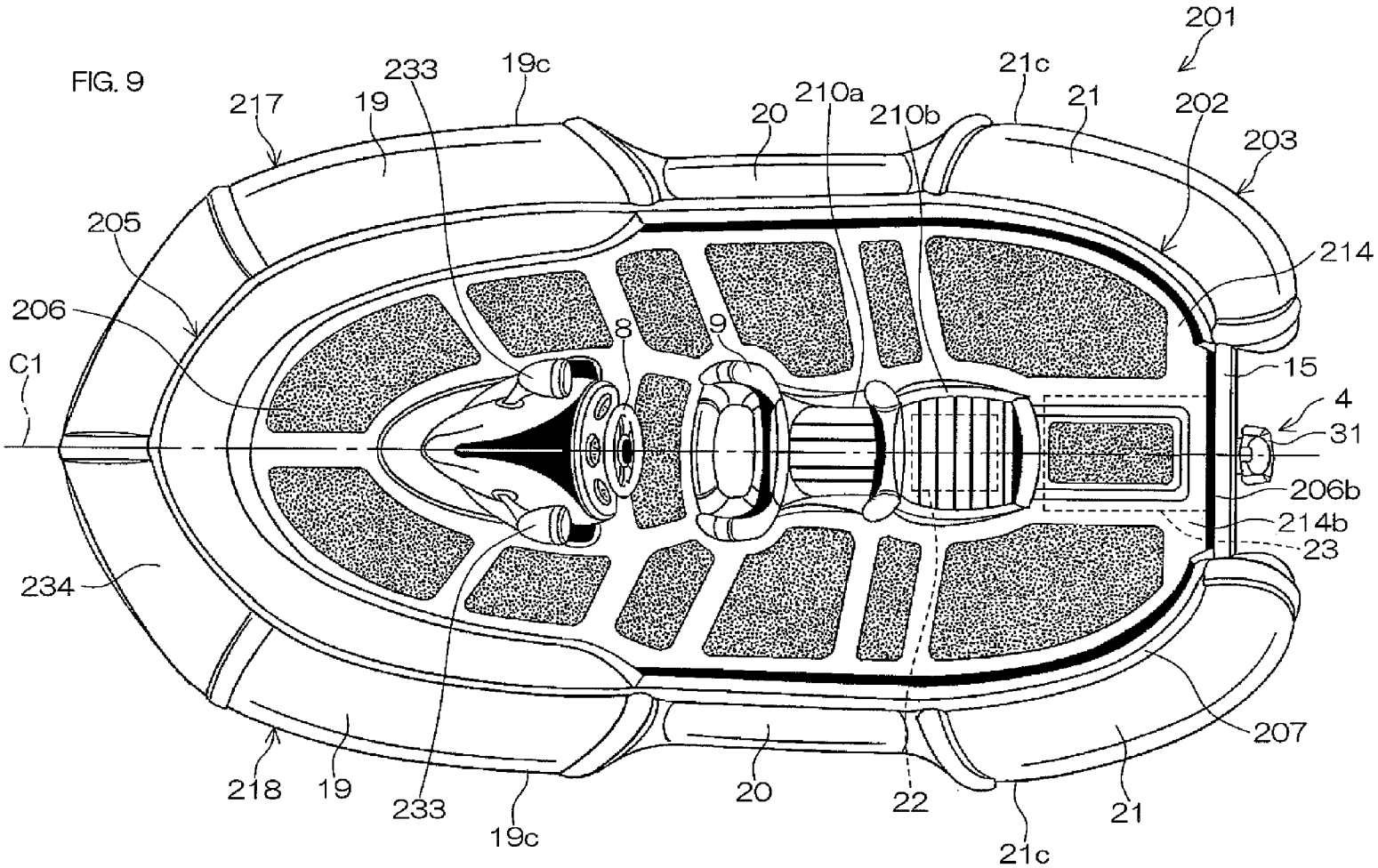
FIG. 9 is a plan view of the vessel according to the second preferred embodiment of the present invention.

As shown in FIG. 9, the body 202 includes a hull 205 with a wide width that defines a vessel bottom, and a flat deck 206 disposed over the hull 205. The hull 205 has a bilaterally symmetric shape. The propulsion unit 4 is held by the hull 205. The propulsion unit 4 is disposed along the body center C1.

Figure 7:
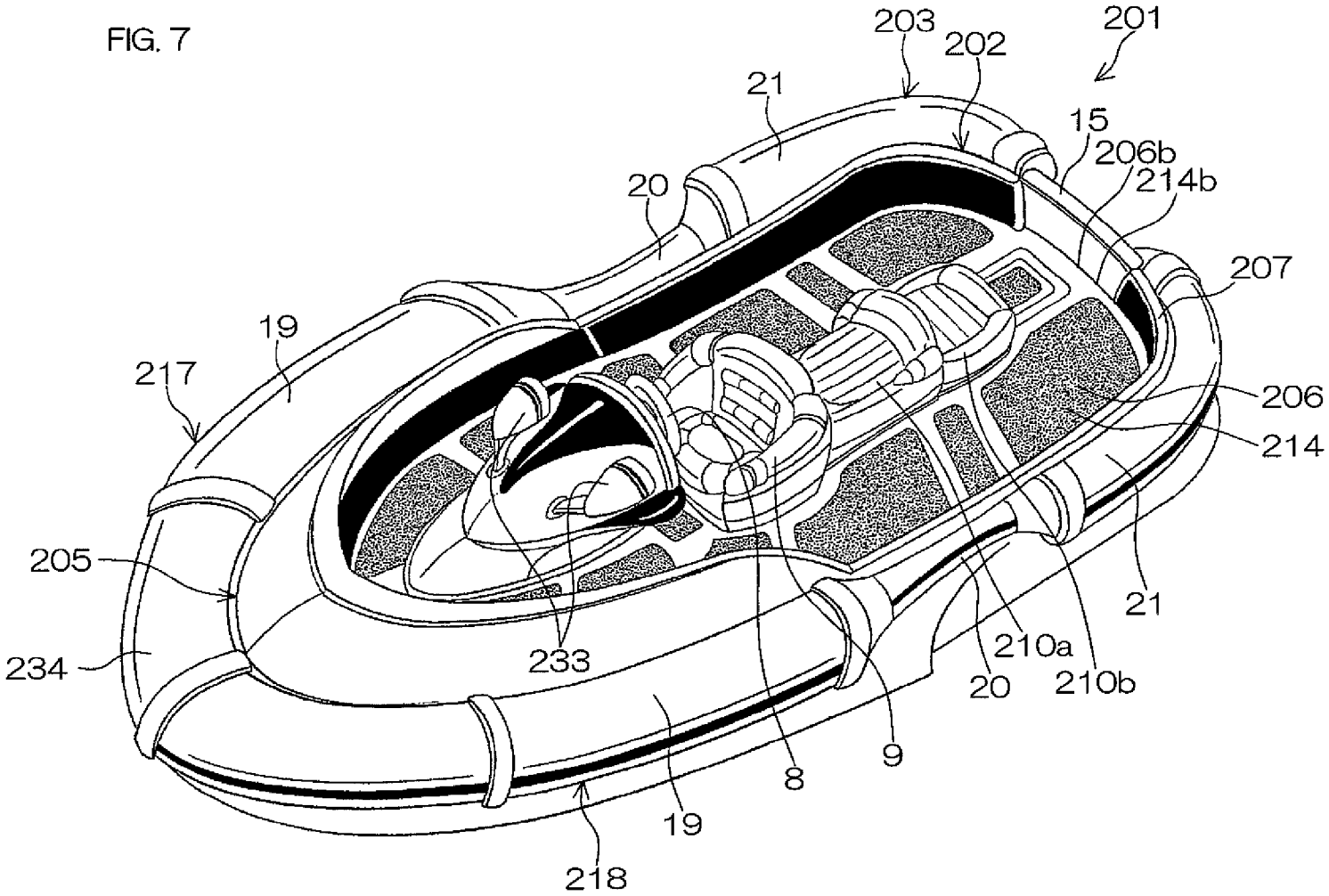
FIG. 7 is a perspective view of a vessel according to a second preferred embodiment of the present invention.

As shown in FIG. 7, the hull 205 includes an outer panel 207 having a C shape opened rearward in a plan view. The outer panel 207 surrounds the deck 206, and defines a passenger space in conjunction with the deck 206. A cockpit is provided in the passenger space. Specifically, as shown in FIG. 9, the seat 9 is disposed at the center portion in the front/rear direction of the deck 206, and the steering handle 8 is disposed in front of the seat 9. On the diagonally forward right and diagonally forward left of the steering handle 8, mirrors 233 to look toward the rear are disposed. Two rear seats 210*a* and 210*b* are disposed at the rear of the seat 9. An output adjustment lever is also disposed in the cockpit although it is not illustrated. The rear seats 210*a* and 210*b* are passenger seats on which passengers other than an operator sit. The rear seats 210*a* and 210*b* may be saddle-shaped seats, for example. The three seats (the seat 9 and the rear seats 210*a* and 210*b*) are laid in a row in the front/rear direction. The steering handle 8 is disposed above the deck 206, and the seat 9 and the rear seats 210*a* and 210*b* are disposed on the deck 206. The steering handle 8, the seat 9, and the rear seats 210*a* and 210*b* are lined up in the front/rear direction along the body center C1.

As shown in FIG. 9, the deck 206 includes a flat portion 214 having an O shape in a plan view, surrounding the steering handle 8 and the three seats (the seat 9 and the rear seats 210*a* and 210*b*) in a plan view. Therefore, the flat portion 214 is disposed on the right and left of the seat 9. The flat portion 214 extends from the lateral side of the seat 9 to the rear end edge 206*b* of the deck 206. The shape of the flat portion 214 is not limited to the O shape, and may be a U shape opened forward or rearward in a plan view. The flat portion 214 is not necessarily linked at the front side or rear side of the seat 9. Specifically, a straight flat portion extending from the lateral side of the seat 9 to the rear end edge 206*b* of the deck 206 may be provided on at least one of the right side and the left side of the seat 9. As shown in FIG. 7, the rear end portion 214*b* of the flat portion 214 is disposed at the opening portion of the outer panel 207. The opening portion of the outer panel 207 is closed by the rear door 15 disposed at the rear end portion 214*b* of the flat portion 214.

As shown in FIG. 9, the float 203 has a U shape opened rearward in a plan view. The float 203 includes a right float 217 and a left float 218 disposed on the right side and the left side of the hull 205, and a front float 234 disposed at the front of the hull 205. The float 203 has a bilaterally symmetric shape. Specifically, the right float 217 and the left float 218 are disposed bilaterally symmetrically so as to be spaced from each other in the right/left direction, and the right float 217 has a shape right/left-reverse to the left float 218. The right end portion and the left end portion of the front float 234 are coupled to the right float 217 and the left float 218, respectively. The right float 217 and the left float 218 extend in the front/rear direction along the side surfaces (outer surfaces) of the hull 205. The right float 217 and the left float 218 are disposed on the outermost side of the vessel 201, and define side surfaces of the vessel 201. As shown in FIG. 8, the attachment position of the float 203 to the hull 205 is set so that the height of the draft line DL1 in a stationary state of the vessel 201 becomes equal to the position of the float 203.

As shown in FIG. 8, the right float 217 and the left float 218 extend in the front/rear direction along the center portion in the up/down direction of the hull 205. The right float 217 and the left float 218 extend rearward from the front end of the hull 205. As shown in FIG. 10, when the vessel 201 is viewed from the back, the rear end portion 214*b* of the flat portion 214 is positioned between the rear end portion of the right float 217 and the rear end portion of the left float 218. As shown in FIG. 8, each of the right float 217 and the left float 218 includes the front portion 19 disposed forward relative to the seat 9, the rear portion 21 disposed rearward relative to the seat 9, and the narrow portion 20 disposed between the front portion 19 and the rear portion 21. The narrow portion 20 is disposed at a position corresponding to the seat 9 with respect to the front/rear direction (the right side or left side of the seat 9).

As shown in FIG. 9, the narrow portion 20 is disposed on the inner side (body center C1 side) relative to the outer end 19*c* of the front portion 19 and the outer end 21*c* of the rear portion 21. Therefore, the right float 217 and the left float 218 are concave inward at the position corresponding to the seat 9. Therefore, the center portion in the front/rear direction of the vessel 201 is narrower in width than the portions forward and rearward of the center portion, and narrowed in the right/left direction like a petiole of an ant. Further, as shown in FIG. 8, the narrow portion 20 is narrower in the up/down direction than the front portion 19 and the rear portion 21. The narrow portion 20 is disposed lower than the upper end 19*a* of the front portion 19 and the upper end 21*a* of the rear portion 21, and disposed higher than the lower end 19*b* of the front portion 19 and the lower end 21*b* of the rear portion 21. Therefore, the right float 217 and the left float 218 are concave up and down at the position corresponding to the seat 9.

As shown in FIG. 11, the propulsion unit 4 includes the power source 22 disposed between the hull 205 and the deck 206, and the jet pump 23 to be driven by the power source 22. The power source 22 is disposed at the front of the jet pump 23. The jet pump 23 is disposed on the stern. The power source 22 is disposed in an engine room provided underneath the rear seat 210*b* on the rear side and the deck 206, and a portion of the jet pump 23 is disposed underneath the deck 206. The jet pump 23 is powered from the power source 22 and suctions water from the vessel bottom and jets the suctioned water rearward or forward. Accordingly, the vessel 201 is propelled. Further, the jet pump 23 changes the direction of the jet flow to the right/left according to an operation of the steering handle 8. Accordingly, the vessel 201 is steered.

As described above, in the second preferred embodiment, as in the first preferred embodiment, the flat portion 214 extending from the lateral side of the seat 9 to the rear end edge 206*b* of the deck 206 is provided on the deck 206. Further, the pair of narrow portions 20 are provided on the float 203. Therefore, a passenger can easily move an object between a position inside the vessel and a position outside the vessel. Therefore, workability on the vessel is excellent.

Figure 12:
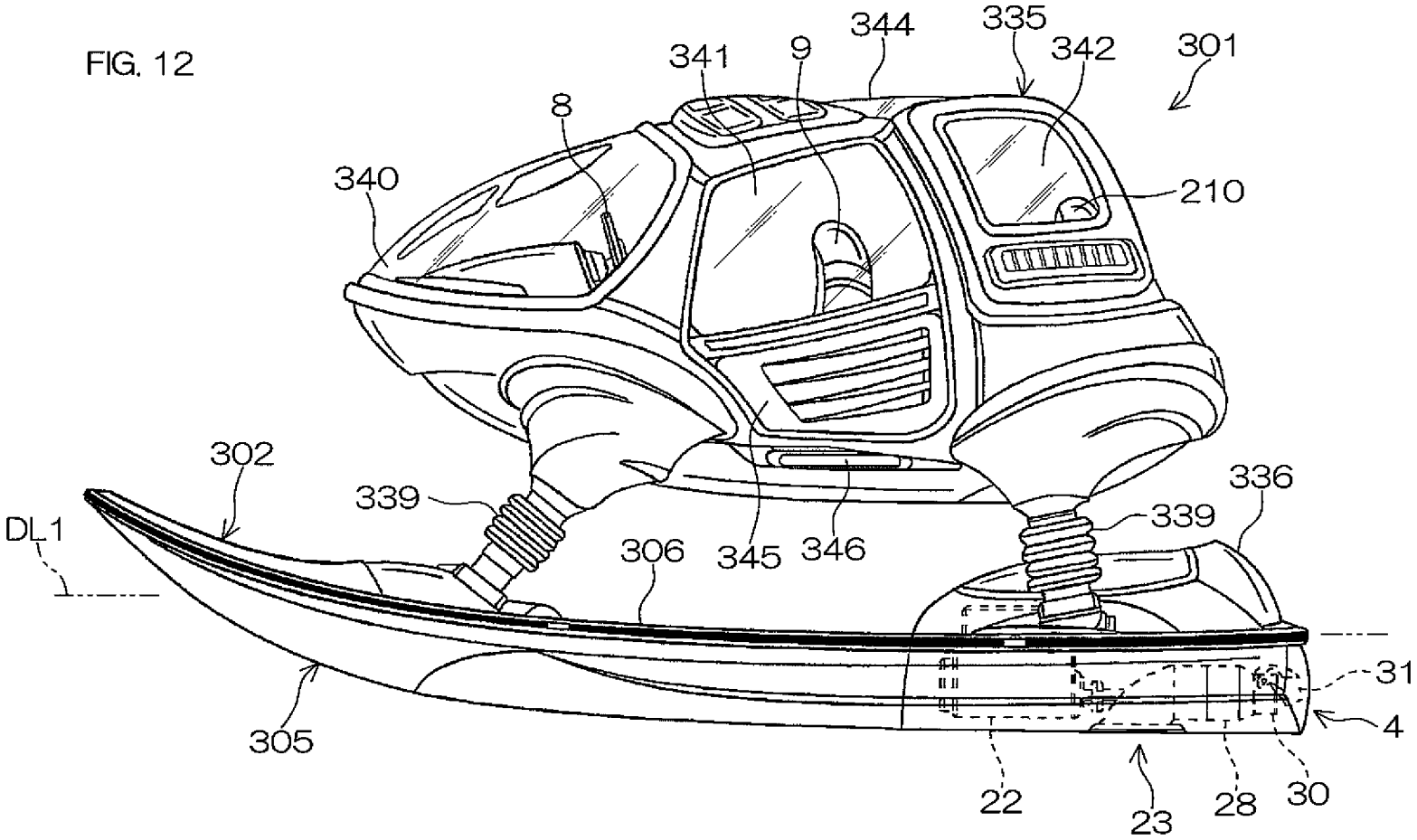
FIG. 12 is a side view of a vessel according to a third preferred embodiment of the present invention.
Figure 13:
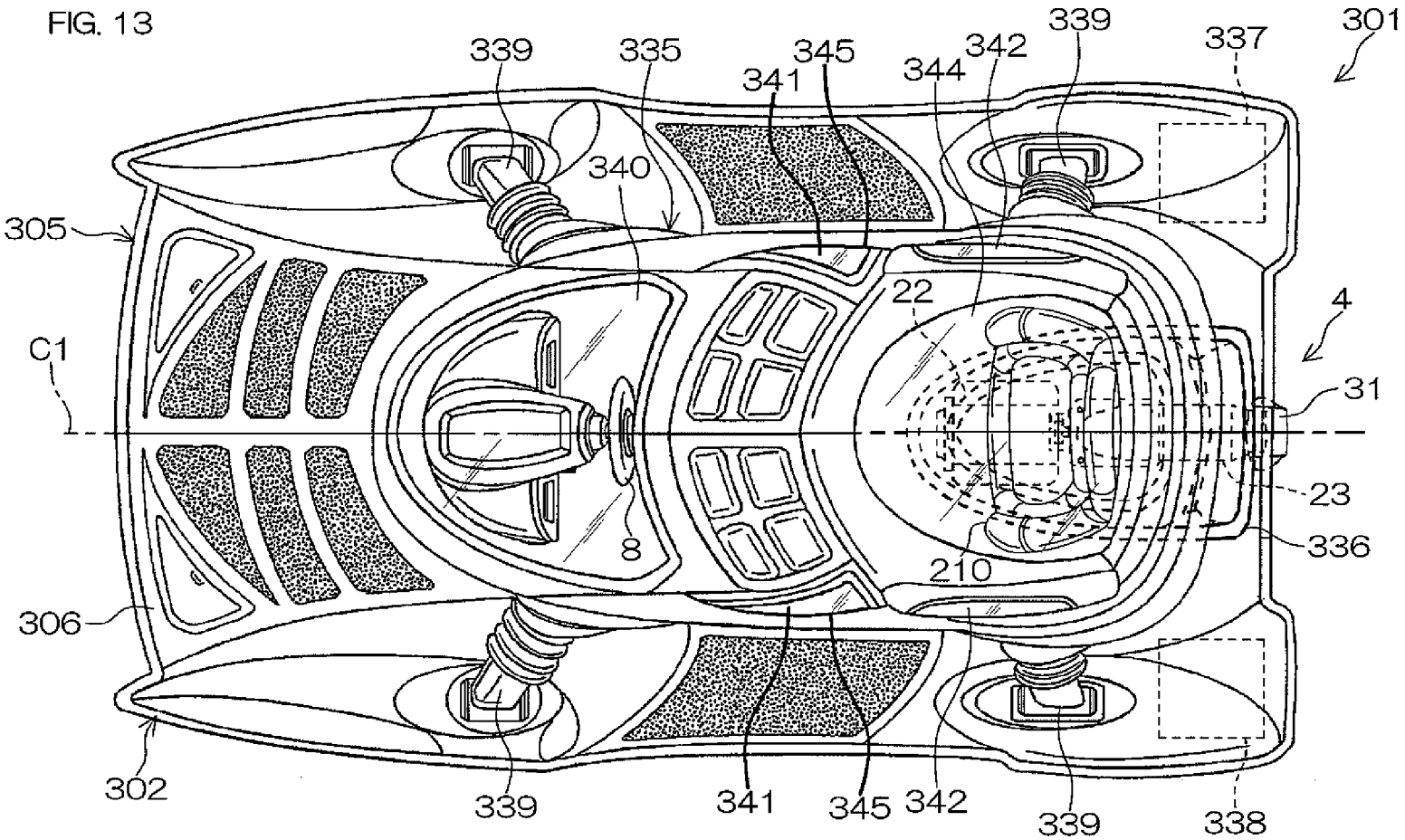
FIG. 13 is a plan view of the vessel according to the third preferred embodiment of the present invention.
Figure 14:
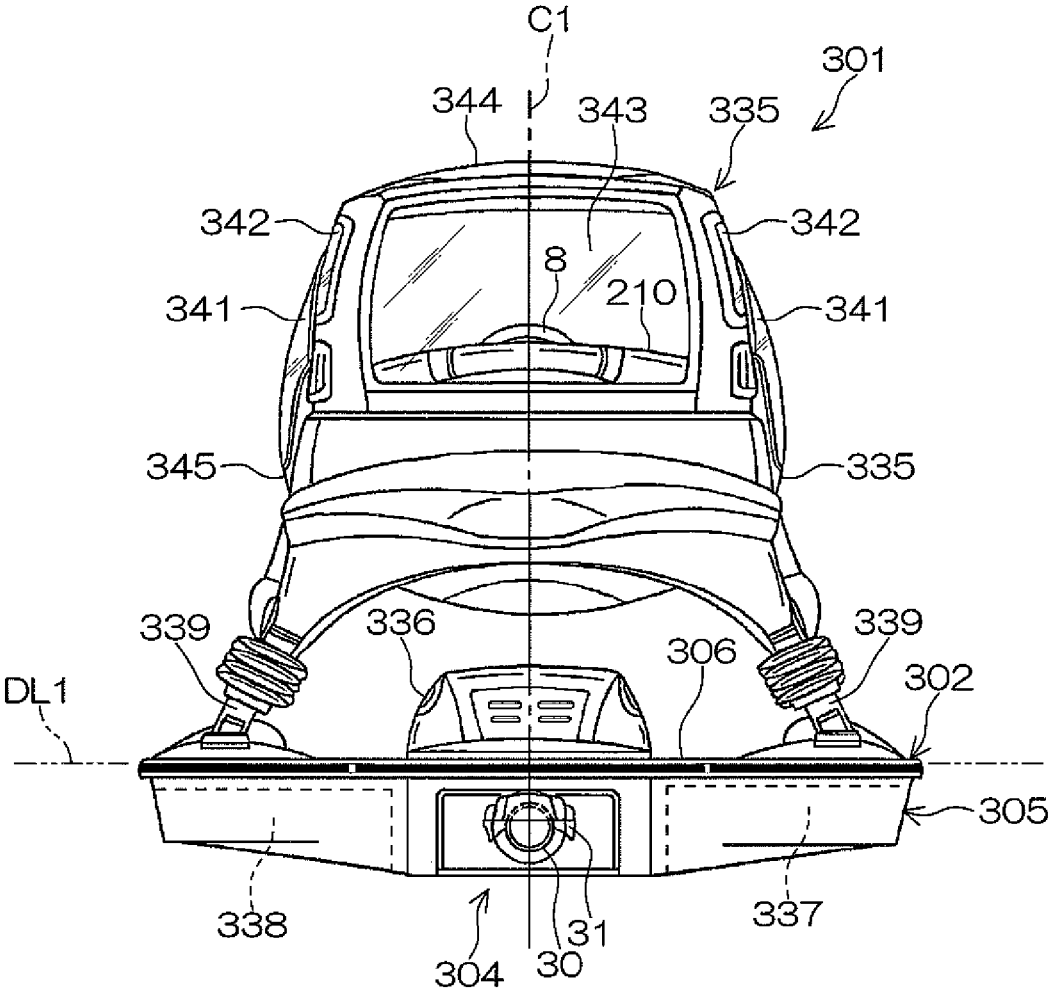
FIG. 14 is a back view of the vessel according to the third preferred embodiment of the present invention.
Figure 15:
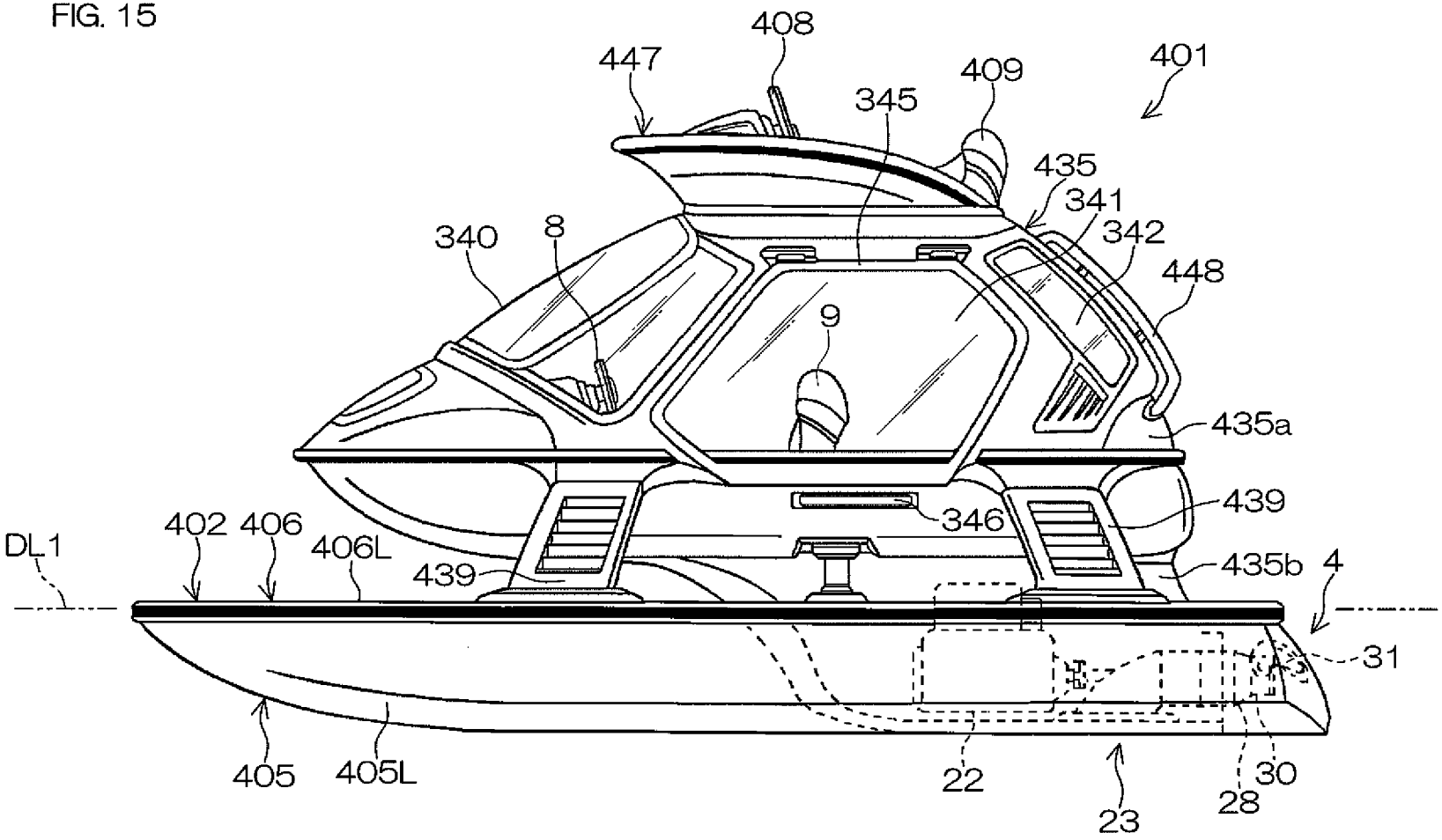
FIG. 15 is a side view of a vessel according to a fourth preferred embodiment of the present invention.
Figure 16:
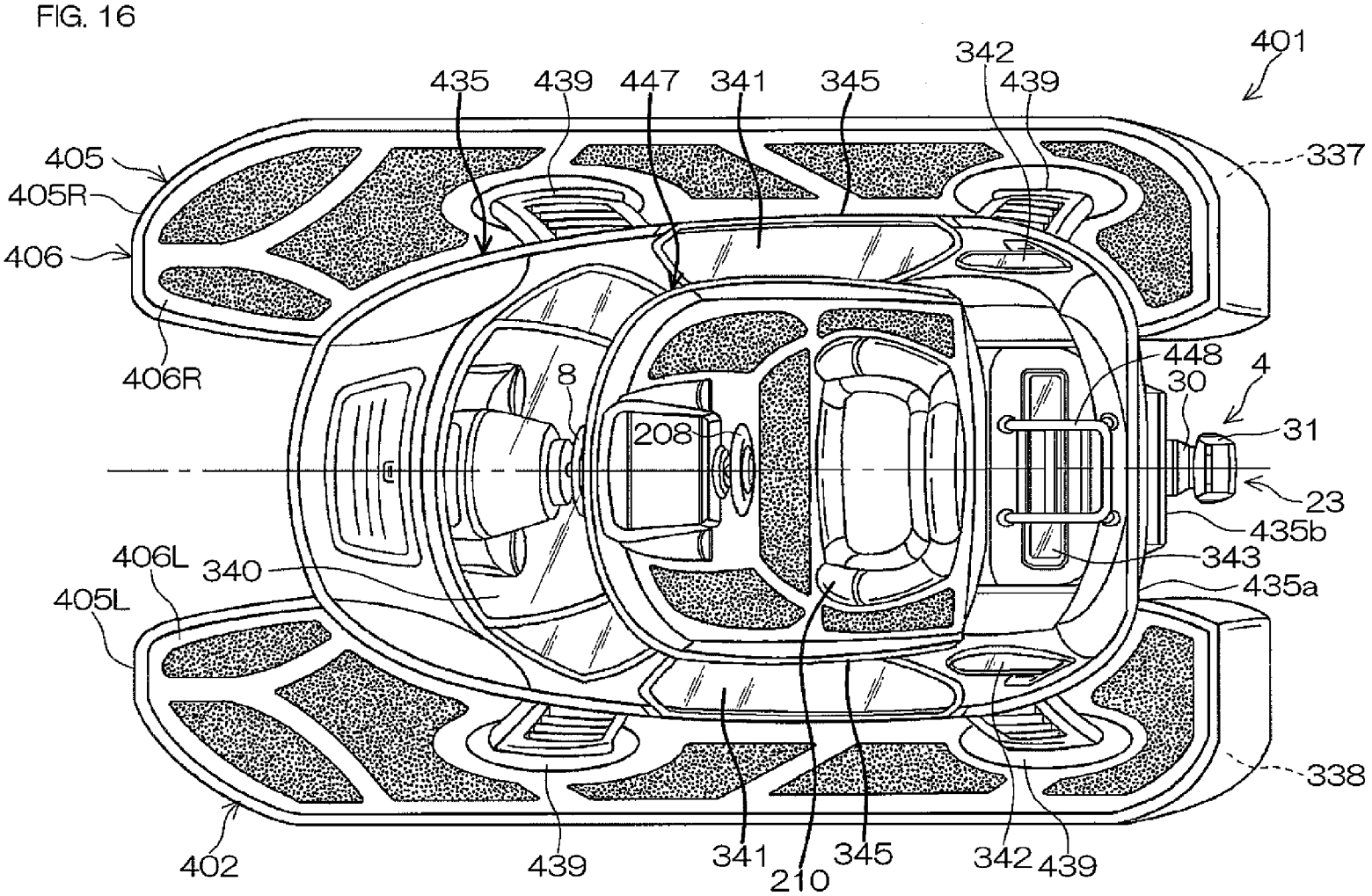
FIG. 16 is a plan view of the vessel according to the fourth preferred embodiment of the present invention.
Figure 17:
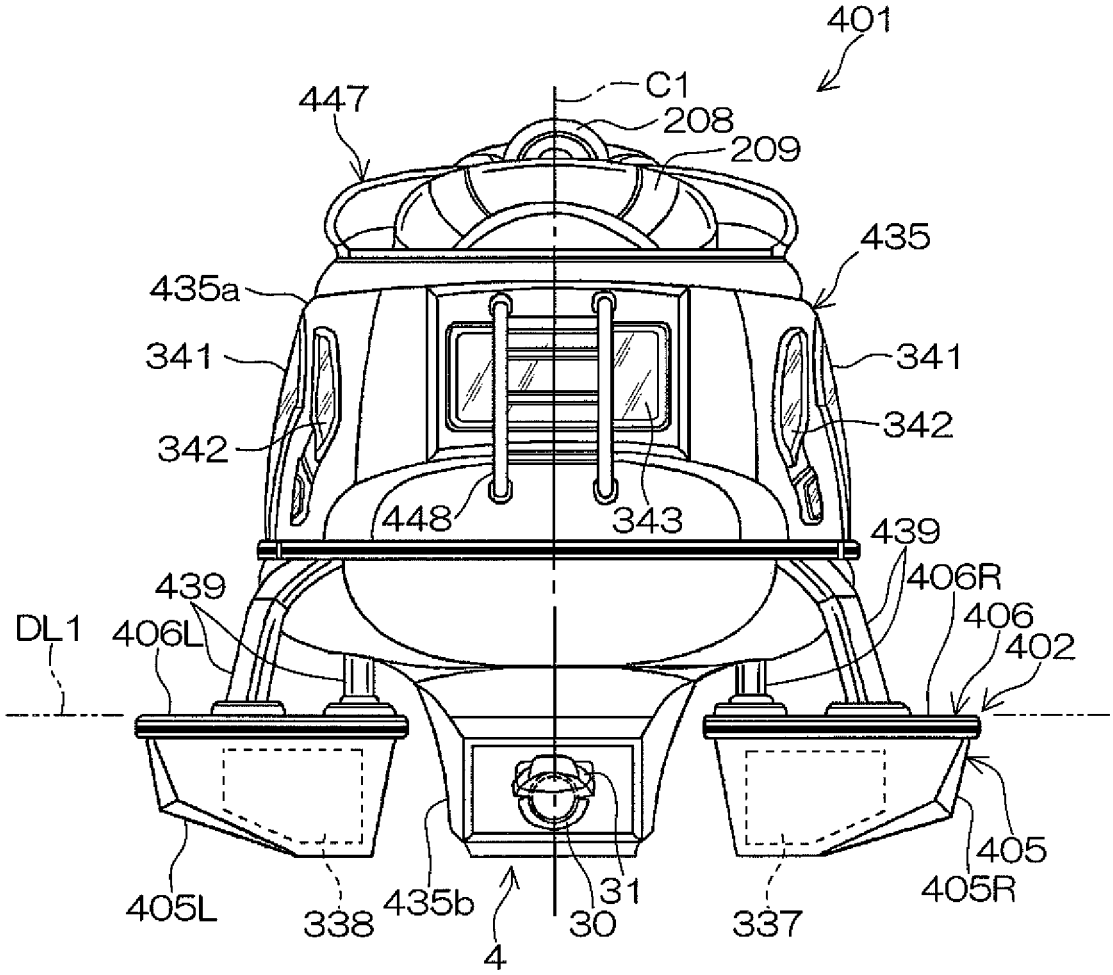
FIG. 17 is a back view of the vessel according to the fourth preferred embodiment of the present invention.

FIG. 12 to FIG. 17 are drawings for describing the Upside Cabin Vehicle. FIG. 12 to FIG. 14 show a "Bay Bison" type Upside Cabin Vehicle, and FIG. 15 to FIG. 17 show a "Lake Bear" type Upside Cabin Vehicle. Hereinafter, features of the Upside Cabin Vehicle are described. Thereafter, detailed arrangements of the Upside Cabin Vehicle are described.

The Upside Cabin Vehicle includes an independent cockpit and cabin placed on top of a relatively flat hull. With an enclosed cabin, it is possible to enjoy a long season with the added advantage of the enjoyment of steering the vessel from an elevated position.

The deck can also be conveniently used for a swimming platform or for fishing, etc. In terms of its engine, a jet propulsion type engine is the most ideal for easy launch and return off the beach.

The engine, its propulsion device, fuel tank, and battery, etc., are all arranged in a flat hull underneath the cabin. This ensures a low center of gravity even with the high structural design of the vessel.

In addition, it is best to have a solid cabin in order to be able to enjoy a longer season. However, it is also possible to have an awning fitted onto the flying bridge.

This Plan introduces the Mono Hull "Bay Bison" and the Catamaran Hull "Lake Bear."

For the "Bay Bison," the cockpit of the cabin is fitted on top of a flat wide hull, and the engine and its jet propulsion device are fitted to the center rear of the hull. Also fitted within the hull are the fuel tank, battery, storage box, and flotation device. There is also room to fit a water tank if necessary. The cabin can be accessed by a door at the side, and the driver's seat is positioned at the front of the interior, along with a passenger's seat placed behind it. In addition, a step for access to the deck is located below the door. As the design of the Bison is durable, it provides a useful new tool in water even through the winter months.

The "Lake Bear" has its cockpit fitted cabin located on top of a flat Catamaran type hull as well as a flying bridge making it possible to steer the vessel from either position. The flying bridge has a passenger capacity for one person, and is accessed via a step located at the rear of the cabin. The engine including its jet propulsion device is fitted at the bottom of the hull beneath the cabin, however, there is provision for a second engine if required. Within the left and right hulls are the fuel tank, battery, storage box, and flotation device. There is also room to fit a water tank if necessary.

As the design of the Bear is stable, it enables discovery of new marine recreation with the combination of the deck, cabin, and flying bridge.

Third Preferred Embodiment

Bay Bison Type Upside Cabin Vehicle

FIG. 12 to FIG. 14 are a side view, a plan view, and a back view of a vessel 301. In FIG. 12 to FIG. 14, components equivalent to the components shown in FIG. 1 to FIG. 11 described above are designated by the same reference numerals as in FIG. 1, etc., and description thereof is omitted.

As shown in FIG. 14, the vessel 301 is a Mono hull type water vehicle to be propelled by a jet propulsion engine. The vessel 301 includes a body 302, a cabin 335 supported by the body 302, and the propulsion unit 4 that propels the vessel 301.

As shown in FIG. 14, the body 302 includes a hull 305 with a wide width that defines a vessel bottom that is wide in width and flat, and a flat deck 306 disposed over the hull 305. As shown in FIG. 12, the body 302 includes an engine room 336 provided at the stern. The engine room 336 projects upward from the deck 306, and extends in the front/rear direction along the body center C1. The power source 22 of the propulsion unit 4 is disposed inside the engine room 336.

As shown in FIG. 14, a fuel tank 337 that stores fuel to be supplied to the propulsion unit 4 is disposed inside the hull 305. Similarly, a battery 338 that supplies electric power to electric devices installed in the vessel 301 is disposed inside the hull 305. Specifically, furniture and fixtures such as the fuel tank 337, the battery 338, a storage box, life jackets, and a water tank are disposed inside the body 302. Accordingly, the gravity center of the vessel 301 is lowered. Buoyancy of the hull 305 is set so that the cabin 335 is positioned higher than the water surface in each of a stationary state and a running state of the vessel 301.

As shown in FIG. 12, the cabin 335 is disposed above the body 302. The cabin 335 is supported by the body 302 via a plurality of support posts 339 extending upward from the body 302. Therefore, the cabin 335 is supported by the body 302 at a distance from the body 302. As shown in FIG. 13, the cabin 335 extends in the front/rear direction along the body center C1. The width of the cabin 335 is narrower than that of the hull 305, and the length of the cabin 335 in the front/rear direction is shorter than that of the hull 305. Therefore, the area of the cabin 335 is narrower than that of the hull 305. When the vessel 301 is viewed from above, the cabin 335 is disposed at a position deflected to the rear side with respect to the hull 305. As shown in FIG. 12, a portion of the engine room 336 is disposed below the cabin 335, and overlaps the cabin 335 in the up/down direction.

As shown in FIG. 12, the cabin 335 defines a closed passenger space. The cockpit is provided in the cabin 335. Specifically, the steering handle 8, the seat 9, and the rear seat 210 are disposed in the passenger space. An output adjustment lever is also disposed in the passenger space although it is not illustrated. The steering handle 8 is disposed in the front portion of the passenger space, and the seat 9 is disposed at the rear of the steering handle 8. The rear seat 210 is disposed at the rear of the seat 9.

As shown in FIG. 12, the cabin 335 includes a plurality of windows (a front window 340, door windows 341, side windows 342, a rear window 343, and an upper window 344) provided on the front portion, the side portions, the rear portion, and the upper portion of the cabin 335. The windows 341 to 344 are screened by transparent plates made of glass or resin. The cabin 335 further includes side doors 345 integrated with the door windows 341, provided on the right side portion and the left side portion of the cabin 335. Steps 346 to be used for movement between the cabin 335 and the deck 306 are attached to the side surfaces of the cabin 335 below the side doors 345. The side doors 345 may be openable and closable in the right/left direction or openable and closable in the up-down direction.

As described above, in the third preferred embodiment, the cabin 335 independent of the hull 305 is provided. The cockpit is provided in the closed cabin 335. Therefore, an operator can steer the vessel 301 without getting wet in all weather. Further, the cockpit is disposed higher than the hull 305, and a vessel steering position is high, so that visibility is high. Therefore, an operator can operate the vessel 301 with comfort.

Fourth Preferred Embodiment

Lake Bear Type Upside Cabin Vehicle

FIG. 15 to FIG. 17 are a side view, a plan view, and a rear view of a vessel 401, respectively. In FIG. 15 to FIG. 17, components equivalent to the components shown in FIG. 1 to FIG. 14 described above are designated by the same reference numerals as in FIG. 1, etc., and description thereof is omitted.

As shown in FIG. 17, the vessel 401 is a Catamaran type water vehicle to be propelled by a jet propulsion engine. The vehicle 401 includes a body 402, a cabin 435 supported by the body 402, a flying bridge 447 disposed above the cabin 435, and the propulsion unit 4 that propels the vessel 401.

As shown in FIG. 17, the body 402 includes a hull 405 that defines a vessel bottom, and a flat deck 406 disposed over the hull 405. The hull 405 includes two hulls (a right hull 405R and a left hull 405L) disposed parallel or substantially parallel to each other so as to be spaced from each other in the right/left direction. As shown in FIG. 16, the right hull 405R and the left hull 405L extend in the front/rear direction on both right and left sides of the vessel center C1. The right hull 405R and the left hull 405L are disposed bilaterally symmetrically, and the right hull 405R has a shape right/left-reverse to the left hull 405L. The deck 406 includes a flat right deck 406R disposed over the right hull 405R and a flat left deck 406L disposed over the left hull 405L.

As shown in FIG. 17, the fuel tank 337 is disposed inside the rear portion of the right hull 405R, and the battery 338 is disposed inside the rear portion of the left hull 405L. Specifically, furniture and fixtures such as the fuel tank 337, the battery 338, the storage box, life jackets, and the water tank, etc., are disposed inside the body 402. Accordingly, the gravity center of the vessel 401 is lowered. Buoyancy of the hull 405 is set so that the cabin 435 (in detail, the upper portion 435*a* of the cabin 435) is positioned higher than the water surface in each of a stationary state and a running state of the vessel 401.

As shown in FIG. 15, the cabin 435 is supported by the body 402 via a plurality of support posts 439 extending upward from the body 402. The cabin 435 is supported by the body 402 at a distance from the body 402. As shown in FIG. 16, the cabin 435 extends in the front/rear direction along the body center C1. The width of the cabin 435 is narrower than that of the hull 405, and the length of the cabin 435 in the front/rear direction is shorter than that of the hull 405. Therefore, the area of the cabin 435 is narrower than that of the hull 405. When the vessel 401 is viewed from above, the cabin 435 is disposed at a position deflected to the rear side with respect to the hull 405.

As shown in FIG. 15, the cabin 435 includes a hollow upper portion 435*a* that defines a closed passenger space, and a lower portion 435*b* extending downward from the upper portion 435*a*. As shown in FIG. 17, the lower portion 435*b* is disposed between the right hull 405R and the left hull 405L, and extends in the front/rear direction along the body center C1. As shown in FIG. 15, the length of the lower portion 435*b* in the front/rear direction is shorter than the right hull 405R and the left hull 405L. The lower portion 435*b* is disposed at a position deflected to the rear side with respect to the hull 405. The propulsion unit 4 is held by the lower portion 435*b*.

A cockpit is provided in the cabin 435. Specifically, as shown in FIG. 15, the steering handle 8 and the seat 9 are disposed in the passenger space (inside the upper portion 435*a*). An output adjustment lever is also disposed in the passenger space although it is not illustrated. The steering handle 8 is disposed in the front portion of the passenger space, and the seat 9 is disposed at the rear of the steering handle 8. The cabin 435 includes the plurality of windows (the front window 340, door windows 341, side windows 342, and the rear window 343) provided on the front portion, the side portions, and the rear portion of the cabin 435. Further, the cabin 435 includes side doors 345 integrated with the door windows 341, provided on the right side portion and the left side portion of the cabin 435. Steps 346 are attached to the side surfaces of the cabin 435 below the side doors 345. The side doors 345 are, for example, swing doors openable and closable up and down around the upper end portions.

As shown in FIG. 15, the flying bridge 447 is supported by the cabin 435. The flying bridge 447 is disposed at the uppermost portion of the vessel 401. As shown in FIG. 16, the flying bridge 447 is disposed along the body center C1. The area of the flying bridge 447 is narrower than that of the cabin 435. The flying bridge 447 has a cup shape opened upward. The flying bridge 447 defines a passenger space. A step 448 (ladder) to be used for movement between the flying bridge 447 and the deck 406 is attached to the back surface of the cabin 435 at the rear of the flying bridge 447.

As shown in FIG. 15, a cockpit different from the above-described cockpit is provided inside the flying bridge 447. Specifically, a steering handle 408 and a seat 409 are disposed inside the flying bridge 447. An output adjustment lever is also disposed inside the flying bridge 447 although it is not illustrated. The seat 409 is an operator seat on which an operator sits. The propulsion unit 4 is connected to the two cockpits, and an operator can operate the propulsion unit 4 from each of the two cockpits.

As described above, in the fourth preferred embodiment, the cabin 435 independent of the hull 405 is provided. The cockpit is provided inside the closed cabin 435. Therefore, an operator can steer the vessel 401 without getting wet in all weather. Further, the cockpit is disposed higher than the hull 405 and the steering position is high, so that visibility is high. In addition, the flying bridge 447 is disposed above the cabin 435, and another cockpit is provided in the flying bridge 447, so that an operator can operate the vessel 401 from a higher position by utilizing the flying bridge 447. Therefore, an operator can operate the vessel 401 with more comfort.

Other Preferred Embodiments

The first to fourth preferred embodiments of the present invention have been described above, however, the present invention is not limited to the contents of the first to fourth preferred embodiments described above, and can be variously changed within the scope of claims.

For example, in the first and second preferred embodiments, a case where a rear door is preferably provided is described. However, it is also possible that the rear door is not provided, and the rear end portion of the deck is opened.

In the first preferred embodiment, a case where a division member is preferably provided at the intermediate portion in the front/rear direction of the flat portion is described, and in the second preferred embodiment, a case where the division member preferably is not provided at the intermediate portion in the front/rear direction of the flat portion. However, it is also possible that the division member is not provided in the vessel according to the first preferred embodiment, and the division member is provided in the vessel according to the second preferred embodiment.

In the first preferred embodiment, a case where a side seat is preferably provided is described, and in the second preferred embodiment, a case where a rear seat is preferably provided is described. However, it is also possible that a rear seat is provided in addition to the side seat in the vessel according to the first preferred embodiment. Similarly, it is also possible that a side seat is provided in addition to the rear seat in the vessel according to the second preferred embodiment. Of course, it is also possible that only the operator seat is provided and the side seat and the rear seat are not provided. Similarly, in the third and fourth preferred embodiment, it is also possible that at least one of the side seat and the rear seat is provided in addition to the operator seat, or only the operator seat is provided.

In the first preferred embodiment, a case where two propulsion units are preferably provided in the vessel is described. However, the number of propulsion units may be one, or may be three or more. Similarly, in the vessels according to the second to fourth preferred embodiments, the number of propulsion units is not limited to one, and may be two or more.

In the first to fourth preferred embodiments, a case where the propulsion unit preferably includes a reverse bucket is described. However, the propulsion unit may not include a reverse bucket.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel comprising:

a body including a hull and a deck disposed over the hull;

a float configured to be inflatable with gas, disposed on right and left sides of the hull, and extending in a front/rear direction along the hull;

at least one propulsion unit including a power source disposed between the hull and the deck, and a jet pump to be driven by the power source;

a steering handle disposed above the deck; and at least one seat disposed on the deck rearward relative to the steering handle; wherein the deck includes a flat portion extending from a lateral side of the at least one seat to a rear end edge of the deck;

the vessel further includes an openable and closable door that, when the door is in a closed position, divides a space above the flat portion and, in combination with at least the float, surrounds the flat portion in a plan view of the vessel; and the float includes a front portion disposed forward relative to the at least one seat, and a pair of narrow portions that are disposed on both right and left sides of the hull at a position corresponding to the at least one seat with respect to the front/rear direction, and disposed lower than an upper surface of the front portion.

2. The vessel according to claim 1, wherein the float includes a pair of rear end portions spaced from each other in a right/left direction, and the flat portion includes a rear end portion positioned between the pair of rear end portions as viewed from a back of the vessel.

3. The vessel according to claim 1, wherein the door is disposed at a rear end portion of the flat portion and divides the space above the flat portion in the front/rear direction.

4. A vessel comprising:

a body including a hull and a deck disposed over the hull;

a float configured to be inflatable with gas, disposed on right and left sides of the hull, and extending in a front/rear direction along the hull;

at least one propulsion unit including a power source disposed between the hull and the deck, and a jet pump to be driven by the power source;

a steering handle disposed above the deck; and at least one seat disposed on the deck rearward relative to the steering handle; wherein the deck includes a flat portion extending from a lateral side of the at least one seat to a rear end edge of the deck;

the vessel further includes an openable and closable door that, when the door is in a closed position, divides a space above the flat portion and, in combination with at least the float, surrounds the flat portion in a plan view of the vessel; and the float is made of a rubber tube and an inside of the rubber tube is filled with gas.

5. A vessel comprising:

a body including a hull and a deck disposed over the hull;

a float configured to be inflatable with gas, disposed on right and left sides of the hull, and extending in a front/rear direction along the hull;

at least one propulsion unit including a power source disposed between the hull and the deck, and a jet pump to be driven by the power source;

a steering handle disposed above the deck; and at least one seat disposed on the deck rearward relative to the steering handle; wherein the deck includes a flat portion extending from a lateral side of the at least one seat to a rear end edge of the deck;

the vessel further includes an openable and closable door that, when the door is in a closed position, divides a space above the flat portion and, in combination with at least the float, surrounds the flat portion in a plan view of the vessel; and the float is made of foamed plastic.

6. A vessel comprising:

a body including a hull and a deck disposed over the hull;

a float configured to be inflatable with gas, disposed on right and left sides of the hull, and extending in a front/rear direction along the hull;

at least one propulsion unit including a power source disposed between the hull and the deck, and a jet pump to be driven by the power source;

a steering handle disposed above the deck; and at least one seat disposed on the deck rearward relative to the steering handle; wherein the deck includes a flat portion extending from a lateral side of the at least one seat to a rear end edge of the deck;

the vessel further includes an openable and closable door that, when the door is in a closed position, divides a space above the flat portion and, in combination with at least the float, surrounds the flat portion in a plan view of the vessel; and the at least one propulsion unit includes a pair of propulsion units spaced from each other in a right/left direction, and the flat portion extends in the front/rear direction between the pair of propulsion units in a plan view of the vessel.

7. The vessel according to claim 6, further comprising a movable division member that is disposed rearward relative to the at least one seat and divides a space above the flat portion in the front/rear direction.

8. The vessel according to claim 7, further comprising a side seat disposed on the deck on a side opposite to the at least one seat with respect to the flat portion.

9. A vessel comprising:

a body including a hull and a deck disposed over the hull;

a float configured to be inflatable with gas, disposed on right and left sides of the hull, and extending in a front/rear direction along the hull;

at least one propulsion unit including a power source disposed between the hull and the deck, and a jet pump to be driven by the power source;

a steering handle disposed above the deck; and at least one seat disposed on the deck rearward relative to the steering handle; wherein the deck includes a flat portion extending from a lateral side of the at least one seat to a rear end edge of the deck;

the vessel further includes an openable and closable door that, when the door is in a closed position, divides a space above the flat portion and, in combination with at least the float, surrounds the flat portion in a plan view of the vessel; and the flat portion surrounds the steering handle and the at least one seat in a plan view of the vessel.

10. The vessel according to claim 9, further comprising a rear seat disposed rearward relative to the at least one seat above the power source.

11. A vessel comprising:

a body including a hull and a deck disposed over the hull;

a float disposed on right and left sides of the hull, and extending in a front/rear direction along the hull;

at least one propulsion unit including a power source disposed between the hull and the deck, and a jet pump to be driven by the power source;

a steering handle disposed above the deck; and at least one seat disposed on the deck rearward relative to the steering handle; wherein the float includes a front portion disposed forward relative to the at least one seat and a rear portion disposed rearward relative to the at least one seat, and a pair of narrow portions disposed on both right and left sides of the hull at a position corresponding to the at least one seat with respect to the front/rear direction, and upper surfaces of the pair of narrow portions are disposed lower than an upper surface of the front portion and lower than an upper surface of the rear portion.

* * * * *